US009366449B2

(12) United States Patent
Staniforth et al.

(10) Patent No.: US 9,366,449 B2
(45) **Date of Patent: *Jun. 14, 2016**

(54) HUMIDIFYING APPARATUS

(71) Applicant: Dyson Technology Limited, Wiltshire (GB)

(72) Inventors: Mark Joseph Staniforth, Malmesbury (GB); Daniel James Beavis, Malmesbury (GB); Jude Paul Pullen, Malmesbury (GB); Peter David Gammack, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 256 days.

This patent is subject to a terminal disclaimer.

(21) Appl. No.: 13/786,014

(22) Filed: Mar. 5, 2013

(65) Prior Publication Data

US 2013/0234346 A1 Sep. 12, 2013

(30) Foreign Application Priority Data

Mar. 6, 2012 (GB) ..... 1203895.6

(51) Int. Cl.

| | |
|---|---|
| ***B01F 3/04*** | (2006.01) |
| ***F24F 6/14*** | (2006.01) |
| ***F04F 5/16*** | (2006.01) |
| ***F24F 13/26*** | (2006.01) |
| ***F24F 6/12*** | (2006.01) |

(52) U.S. Cl.

CPC ... *F24F 6/14* (2013.01); *F04F 5/16* (2013.01); *F24F 6/12* (2013.01); *F24F 13/26* (2013.01)

(58) Field of Classification Search

CPC ..... B01F 3/04; B01F 3/0407; B01F 3/04021

USPC ..... 261/81, 116, 133

See application file for complete search history.

(56) References Cited

U.S. PATENT DOCUMENTS

| | | | |
|---|---|---|---|
| 284,962 | A | 9/1883 | Huston |
| 1,357,261 | A | 11/1920 | Svoboda |
| 1,767,060 | A | 6/1930 | Ferguson |
| 1,896,869 | A | 2/1933 | Larsh |
| 2,014,185 | A | 9/1935 | Martin |
| 2,035,733 | A | 3/1936 | Wall |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Fitton et al., U.S. Office Action mailed Dec. 31, 2013, directed to U.S. Appl. No. 13/718,693; 8 pages.

(Continued)

*Primary Examiner* — Duane Smith
*Assistant Examiner* — Adam W Bergfelder
(74) *Attorney, Agent, or Firm* — Morrison & Foerster LLP

(57) ABSTRACT

Humidifying apparatus includes a base housing a motor and impeller unit for generating a first air flow. A nozzle includes an interior passage for receiving the first air flow and an air outlet for emitting the first air flow. The nozzle defines an opening through which air from outside the apparatus is drawn by air emitted from the air outlet. The apparatus is configured to humidify a second air flow, which is emitted from a plurality of second air outlets. The second air flow is humidified with water supplied from a water tank mounted on the base. The water tank surrounds at least an upper section of the motor and impeller unit.

13 Claims, 16 Drawing Sheets

(56) References Cited

U.S. PATENT DOCUMENTS

| | | | |
|---|---|---|---|
| 2,071,266 | A | 2/1937 | Schmidt |
| D103,476 | S | 3/1937 | Weber |
| 2,115,883 | A | 5/1938 | Sher |
| D115,344 | S | 6/1939 | Chapman |
| 2,210,458 | A | 8/1940 | Keilholtz |
| 2,258,961 | A | 10/1941 | Saathoff |
| 2,295,502 | A | 9/1942 | Lamb |
| 2,336,295 | A | 12/1943 | Reimuller |
| 2,363,839 | A | 11/1944 | Demuth |
| 2,433,795 | A | 12/1947 | Stokes |
| 2,473,325 | A | 6/1949 | Aufiero |
| 2,476,002 | A | 7/1949 | Stalker |
| 2,488,467 | A | 11/1949 | De Lisio |
| 2,510,132 | A | 6/1950 | Morrison |
| 2,544,379 | A | 3/1951 | Davenport |
| 2,547,448 | A | 4/1951 | Demuth |
| 2,583,374 | A | 1/1952 | Hoffman |
| 2,620,127 | A | 12/1952 | Radcliffe |
| 2,711,682 | A | 6/1955 | Drechsel |
| 2,765,977 | A | 10/1956 | Morrison |
| 2,808,198 | A | 10/1957 | Morrison |
| 2,813,673 | A | 11/1957 | Smith |
| 2,830,779 | A | 4/1958 | Wentling |
| 2,838,229 | A | 6/1958 | Belanger |
| 2,922,277 | A | 1/1960 | Bertin |
| 2,922,570 | A | 1/1960 | Allen |
| 3,004,403 | A | 10/1961 | Laporte |
| 3,047,208 | A | 7/1962 | Coanda |
| 3,270,655 | A | 9/1966 | Guirl et al. |
| D206,973 | S | 2/1967 | De Lisio |
| 3,503,138 | A | 3/1970 | Fuchs et al. |
| 3,518,776 | A | 7/1970 | Wolff et al. |
| 3,724,092 | A | 4/1973 | McCleerey |
| 3,729,934 | A | 5/1973 | Denning et al. |
| 3,743,186 | A | 7/1973 | Mocarski |
| 3,795,367 | A | 3/1974 | Mocarski |
| 3,872,916 | A | 3/1975 | Beck |
| 3,875,745 | A | 4/1975 | Franklin |
| 3,885,891 | A | 5/1975 | Throndson |
| 3,943,329 | A | 3/1976 | Hlavac |
| 4,037,991 | A | 7/1977 | Taylor |
| 4,046,492 | A | 9/1977 | Inglis |
| 4,061,188 | A | 12/1977 | Beck |
| 4,073,613 | A | 2/1978 | Desty |
| 4,090,814 | A | 5/1978 | Teodorescu et al. |
| 4,113,416 | A | 9/1978 | Kataoka et al. |
| 4,136,735 | A | 1/1979 | Beck et al. |
| 4,173,995 | A | 11/1979 | Beck |
| 4,180,130 | A | 12/1979 | Beck et al. |
| 4,184,417 | A | 1/1980 | Chancellor |
| 4,184,541 | A | 1/1980 | Beck et al. |
| 4,192,461 | A | 3/1980 | Arborg |
| 4,264,837 | A | 4/1981 | Gaboriaud |
| 4,332,529 | A | 6/1982 | Alperin |
| 4,336,017 | A | 6/1982 | Desty |
| 4,342,204 | A | 8/1982 | Melikian et al. |
| 4,448,354 | A | 5/1984 | Reznick et al. |
| 4,568,243 | A | 2/1986 | Schubert et al. |
| 4,630,475 | A | 12/1986 | Mizoguchi |
| 4,643,351 | A | 2/1987 | Fukamachi et al. |
| 4,703,152 | A | 10/1987 | Shih-Chin |
| 4,716,946 | A | 1/1988 | Grigoletto |
| 4,718,870 | A | 1/1988 | Watts |
| 4,732,539 | A | 3/1988 | Shin-Chin |
| 4,734,017 | A | 3/1988 | Levin |
| 4,790,133 | A | 12/1988 | Stuart |
| 4,850,804 | A | 7/1989 | Huang |
| 4,878,620 | A | 11/1989 | Tarleton |
| 4,893,990 | A | 1/1990 | Tomohiro et al. |
| 4,978,281 | A | 12/1990 | Conger |
| 5,061,405 | A | 10/1991 | Stanek et al. |
| D325,435 | S | 4/1992 | Coup et al. |
| 5,110,266 | A | 5/1992 | Toyoshima et al. |
| 5,168,722 | A | 12/1992 | Brock |
| 5,176,856 | A | 1/1993 | Takahashi et al. |
| 5,188,508 | A | 2/1993 | Scott et al. |
| D343,231 | S | 1/1994 | Lim |
| 5,296,769 | A | 3/1994 | Havens et al. |
| D346,017 | S | 4/1994 | Lim |
| 5,310,313 | A | 5/1994 | Chen |
| 5,317,815 | A | 6/1994 | Hwang |
| 5,338,495 | A | 8/1994 | Steiner et al. |
| 5,402,938 | A | 4/1995 | Sweeney |
| 5,407,324 | A | 4/1995 | Starnes, Jr. et al. |
| 5,425,902 | A | 6/1995 | Miller et al. |
| 5,435,489 | A | 7/1995 | Jenkins et al. |
| 5,483,616 | A | 1/1996 | Chiu et al. |
| 5,518,370 | A | 5/1996 | Wang et al. |
| D374,712 | S | 10/1996 | Jane et al. |
| 5,609,473 | A | 3/1997 | Litvin |
| 5,645,769 | A | 7/1997 | Tamaru et al. |
| 5,649,370 | A | 7/1997 | Russo |
| D382,951 | S | 8/1997 | Deines et al. |
| 5,671,321 | A | 9/1997 | Bagnuolo |
| 5,677,982 | A | 10/1997 | Levine et al. |
| 5,706,985 | A | 1/1998 | Feer |
| 5,735,683 | A | 4/1998 | Muschelknautz |
| 5,762,034 | A | 6/1998 | Foss |
| 5,762,661 | A | 6/1998 | Kleinberger et al. |
| 5,783,117 | A | 7/1998 | Byassee et al. |
| 5,794,306 | A | 8/1998 | Firdaus |
| D398,983 | S | 9/1998 | Keller et al. |
| 5,841,080 | A | 11/1998 | Iida et al. |
| 5,843,344 | A | 12/1998 | Junkel et al. |
| 5,859,952 | A | 1/1999 | Levine et al. |
| 5,862,037 | A | 1/1999 | Behl |
| 5,868,197 | A | 2/1999 | Potier |
| 5,881,685 | A | 3/1999 | Foss et al. |
| D415,271 | S | 10/1999 | Feer |
| 6,015,274 | A | 1/2000 | Bias et al. |
| D423,663 | S | 4/2000 | Rossman et al. |
| 6,073,881 | A | 6/2000 | Chen |
| D429,808 | S | 8/2000 | Krauss et al. |
| 6,123,618 | A | 9/2000 | Day |
| 6,155,782 | A | 12/2000 | Hsu |
| D435,899 | S | 1/2001 | Melwani |
| 6,200,155 | B1 | 3/2001 | Chudkosky et al. |
| 6,254,337 | B1 | 7/2001 | Arnold |
| 6,269,549 | B1 | 8/2001 | Carlucci et al. |
| 6,278,248 | B1 | 8/2001 | Hong et al. |
| 6,282,746 | B1 | 9/2001 | Schleeter |
| 6,293,121 | B1 | 9/2001 | Labrador |
| 6,321,034 | B2 | 11/2001 | Jones-Lawlor et al. |
| 6,386,845 | B1 | 5/2002 | Bedard |
| 6,480,672 | B1 | 11/2002 | Rosenzweig et al. |
| 6,599,088 | B2 | 7/2003 | Stagg |
| 6,604,694 | B1 | 8/2003 | Kordas et al. |
| D483,851 | S | 12/2003 | Fok |
| D485,895 | S | 1/2004 | Melwani |
| D486,903 | S | 2/2004 | Chiang |
| 6,715,739 | B2 | 4/2004 | Mulvaney et al. |
| 6,789,787 | B2 | 9/2004 | Stutts |
| 6,791,056 | B2 | 9/2004 | VanOtteren et al. |
| 6,830,433 | B2 | 12/2004 | Birdsell et al. |
| 6,845,971 | B2 | 1/2005 | Bachert |
| D512,772 | S | 12/2005 | Lee |
| D513,067 | S | 12/2005 | Blateri |
| 7,059,826 | B2 | 6/2006 | Lasko |
| 7,088,913 | B1 | 8/2006 | Verhoorn et al. |
| 7,147,336 | B1 | 12/2006 | Chou |
| D539,414 | S | 3/2007 | Russak et al. |
| 7,192,258 | B2 | 3/2007 | Kuo et al. |
| 7,198,473 | B2 | 4/2007 | Stickland et al. |
| D544,078 | S | 6/2007 | Geringer |
| 7,412,781 | B2 | 8/2008 | Mattinger et al. |
| 7,478,993 | B2 | 1/2009 | Hong et al. |
| 7,540,474 | B1 | 6/2009 | Huang et al. |
| D595,835 | S | 7/2009 | Fu |
| D598,532 | S | 8/2009 | Dyson et al. |
| D602,143 | S | 10/2009 | Gammack et al. |
| D602,144 | S | 10/2009 | Dyson et al. |
| D605,748 | S | 12/2009 | Gammack et al. |
| 7,660,110 | B2 | 2/2010 | Vinson et al. |
| 7,664,377 | B2 | 2/2010 | Liao |

(56) References Cited

U.S. PATENT DOCUMENTS

| | | | |
|---|---|---|---|
| D614,280 | S | 4/2010 | Dyson et al. |
| 7,731,050 | B2 | 6/2010 | Parks et al. |
| 7,775,848 | B1 | 8/2010 | Auerbach |
| 7,806,388 | B2 | 10/2010 | Junkel et al. |
| 7,841,045 | B2 | 11/2010 | Shaanan et al. |
| D633,997 | S | 3/2011 | Hideharu et al. |
| D633,999 | S | 3/2011 | Hideharu et al. |
| 7,931,449 | B2 | 4/2011 | Fitton et al. |
| D638,114 | S | 5/2011 | Li et al. |
| D643,098 | S | 8/2011 | Wallace et al. |
| 8,002,520 | B2 | 8/2011 | Dawson et al. |
| D644,726 | S | 9/2011 | Hideharu et al. |
| D645,133 | S | 9/2011 | Hideharu |
| D646,373 | S | 10/2011 | Liebson et al. |
| 8,092,166 | B2 | 1/2012 | Nicolas et al. |
| 8,113,490 | B2 | 2/2012 | Chen |
| 8,152,495 | B2 | 4/2012 | Boggess, Jr. et al. |
| 8,246,317 | B2 | 8/2012 | Gammack |
| D669,164 | S | 10/2012 | Hsu |
| 8,308,445 | B2 | 11/2012 | Gammack et al. |
| D672,023 | S | 12/2012 | Wallace et al. |
| D672,024 | S | 12/2012 | Fitton et al. |
| 8,348,629 | B2 | 1/2013 | Fitton et al. |
| 8,356,804 | B2 | 1/2013 | Fitton et al. |
| D676,536 | S | 2/2013 | Roach et al. |
| D678,993 | S | 3/2013 | Kung-Hua |
| 8,403,640 | B2 | 3/2013 | Gammack et al. |
| 8,408,869 | B2 | 4/2013 | Hutton et al. |
| D681,793 | S | 5/2013 | Li |
| D684,249 | S | 6/2013 | Herbst |
| 8,454,322 | B2 | 6/2013 | Gammack et al. |
| 8,469,660 | B2 | 6/2013 | Dyson et al. |
| 8,529,226 | B2 | 9/2013 | Li |
| 8,544,826 | B2 | 10/2013 | Ediger et al. |
| D698,018 | S | 1/2014 | Choi |
| D700,959 | S | 3/2014 | Sickinger et al. |
| 8,684,687 | B2 | 4/2014 | Dyson et al. |
| D705,415 | S | 5/2014 | Lo |
| 8,721,286 | B2 | 5/2014 | Gammack et al. |
| 8,721,307 | B2 | 5/2014 | Li |
| 8,764,412 | B2 | 7/2014 | Gammack et al. |
| 8,783,663 | B2 | 7/2014 | Fitton et al. |
| 8,784,071 | B2 | 7/2014 | Gammack |
| 2001/0017212 | A1 | 8/2001 | Hirano |
| 2002/0104972 | A1 | 8/2002 | Guzorek |
| 2002/0106547 | A1 | 8/2002 | Sugawara et al. |
| 2003/0059307 | A1 | 3/2003 | Moreno et al. |
| 2003/0164367 | A1 | 9/2003 | Bucher et al. |
| 2003/0171093 | A1 | 9/2003 | Gumucio Del Pozo |
| 2003/0190183 | A1 | 10/2003 | Hsing |
| 2004/0022631 | A1 | 2/2004 | Birdsell et al. |
| 2004/0049842 | A1 | 3/2004 | Prehodka |
| 2004/0106370 | A1 | 6/2004 | Honda et al. |
| 2004/0149881 | A1 | 8/2004 | Allen |
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0258554 | A1 | 11/2005 | Bachert |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2006/0263073 | A1 | 11/2006 | Clarke et al. |
| 2006/0279927 | A1 | 12/2006 | Strohm |
| 2007/0035189 | A1 | 2/2007 | Matsumoto |
| 2007/0041857 | A1 | 2/2007 | Fleig |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0237500 | A1 | 10/2007 | Wang |
| 2007/0269323 | A1 | 11/2007 | Zhou et al. |
| 2008/0020698 | A1 | 1/2008 | Spaggiari |
| 2008/0124060 | A1 | 5/2008 | Gao |
| 2008/0152482 | A1 | 6/2008 | Patel |
| 2008/0166224 | A1 | 7/2008 | Giffin |
| 2008/0286130 | A1 | 11/2008 | Purvines |
| 2008/0314250 | A1 | 12/2008 | Cowie et al. |
| 2009/0026850 | A1 | 1/2009 | Fu |
| 2009/0032130 | A1 | 2/2009 | Dumas et al. |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0078120 | A1 | 3/2009 | Kummer et al. |
| 2009/0120925 | A1 | 5/2009 | Lasko |
| 2009/0191054 | A1 | 7/2009 | Winkler |
| 2009/0214341 | A1 | 8/2009 | Craig |
| 2010/0133707 | A1 | 6/2010 | Huang |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2011/0236228 | A1 | 9/2011 | Fitton et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0051884 | A1 | 3/2012 | Junkel et al. |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2012/0308375 | A1 | 12/2012 | Gammack |
| 2012/0318393 | A1 | 12/2012 | Tsen |
| 2013/0011252 | A1 | 1/2013 | Crawford et al. |
| 2013/0026664 | A1 | 1/2013 | Staniforth et al. |
| 2013/0028763 | A1 | 1/2013 | Staniforth et al. |
| 2013/0028766 | A1 | 1/2013 | Staniforth et al. |
| 2013/0077292 | A1 | 3/2013 | Zimmerman |
| 2013/0129490 | A1 | 5/2013 | Dos Reis et al. |
| 2013/0142676 | A1 | 6/2013 | Zou |
| 2013/0161842 | A1 | 6/2013 | Fitton et al. |
| 2013/0175711 | A1 | 7/2013 | Nutter et al. |
| 2013/0199372 | A1 | 8/2013 | Nock et al. |
| 2013/0234347 | A1 | 9/2013 | Staniforth et al. |
| 2013/0249122 | A1 | 9/2013 | Staniforth et al. |
| 2013/0249124 | A1 | 9/2013 | Staniforth et al. |
| 2013/0249126 | A1 | 9/2013 | Staniforth et al. |
| 2013/0272858 | A1 | 10/2013 | Stickney et al. |
| 2013/0280051 | A1 | 10/2013 | Nicolas et al. |
| 2013/0280061 | A1 | 10/2013 | Stickney |
| 2013/0280096 | A1 | 10/2013 | Gammack et al. |
| 2013/0309065 | A1 | 11/2013 | Johnson et al. |
| 2013/0309080 | A1 | 11/2013 | Johnson et al. |
| 2013/0323100 | A1 | 12/2013 | Poulton et al. |
| 2013/0336771 | A1 | 12/2013 | Dyson et al. |
| 2014/0017069 | A1 | 1/2014 | Peters |
| 2014/0077398 | A1 | 3/2014 | Staniforth et al. |

(56) References Cited

U.S. PATENT DOCUMENTS

| | | | |
|---|---|---|---|
| 2014/0079566 | A1 | 3/2014 | Gammack et al. |
| 2014/0084492 | A1 | 3/2014 | Staniforth et al. |
| 2014/0210114 | A1 | 7/2014 | Staniforth et al. |
| 2014/0210115 | A1 | 7/2014 | Staniforth et al. |
| 2014/0255173 | A1 | 9/2014 | Poulton et al. |
| 2014/0255217 | A1 | 9/2014 | Li |
| 2015/0084214 | A1 | 3/2015 | Wilson et al. |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 2549372 | 5/2003 |
| CN | 1437300 | 8/2003 |
| CN | 2650005 | 10/2004 |
| CN | 2713643 | 7/2005 |
| CN | 1680727 | 10/2005 |
| CN | 1724950 | 1/2006 |
| CN | 2833197 | 11/2006 |
| CN | 201011346 | 1/2008 |
| CN | 201147215 | 11/2008 |
| CN | 201180678 | 1/2009 |
| CN | 201221477 | 4/2009 |
| CN | 101424279 | 5/2009 |
| CN | 101451754 A | 6/2009 |
| CN | 201281416 | 7/2009 |
| CN | 201349269 | 11/2009 |
| CN | 101684828 | 3/2010 |
| CN | 201486901 | 5/2010 |
| CN | 101726100 | 6/2010 |
| CN | 101749288 | 6/2010 |
| CN | 201502549 | 6/2010 |
| CN | 201507461 | 6/2010 |
| CN | 201518985 | 7/2010 |
| CN | 101825096 | 9/2010 |
| CN | 101825101 | 9/2010 |
| CN | 101825102 | 9/2010 |
| CN | 101825103 | 9/2010 |
| CN | 101825104 | 9/2010 |
| CN | 101825324 | 9/2010 |
| CN | 201568337 | 9/2010 |
| CN | 101858355 | 10/2010 |
| CN | 101936310 | 1/2011 |
| CN | 201696365 | 1/2011 |
| CN | 201696366 | 1/2011 |
| CN | 201739199 U | 2/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201771875 | 3/2011 |
| CN | 201779080 | 3/2011 |
| CN | 201786777 | 4/2011 |
| CN | 201786778 | 4/2011 |
| CN | 201802648 | 4/2011 |
| CN | 301539668 | 5/2011 |
| CN | 102095236 | 6/2011 |
| CN | 201858204 | 6/2011 |
| CN | 201874898 | 6/2011 |
| CN | 201874901 | 6/2011 |
| CN | 201917047 | 8/2011 |
| CN | 102251973 | 11/2011 |
| CN | 102287357 | 12/2011 |
| CN | 202101355 | 1/2012 |
| CN | 102367813 | 3/2012 |
| CN | 202267207 | 6/2012 |
| CN | 301949285 | 6/2012 |
| CN | 202431623 | 9/2012 |
| CN | 102900654 | 1/2013 |
| CN | 103697556 | 4/2014 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 0 459 812 | 12/1991 |
| EP | 0 784 947 | 7/1997 |
| EP | 1 094 224 | 4/2001 |
| EP | 1 138 954 | 10/2001 |
| EP | 1357296 | 10/2003 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| EP | 2 230 467 | 9/2010 |
| EP | 2 414 738 | 2/2012 |
| EP | 2 578 889 | 4/2013 |
| FR | 1033034 | 7/1953 |
| FR | 1119439 | 6/1956 |
| FR | 1.387.334 | 1/1965 |
| FR | 2 375 471 | 7/1978 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| FR | 2928706 | 9/2009 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 861749 | 2/1961 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468317 | 9/2010 |
| GB | 2468319 | 9/2010 |
| GB | 2468320 | 9/2010 |
| GB | 2468323 | 9/2010 |
| GB | 2468328 | 9/2010 |
| GB | 2468329 | 9/2010 |

(56) References Cited

FOREIGN PATENT DOCUMENTS

| | | | |
|---|---|---|---|
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |
| GB | 2484671 | | 4/2012 |
| GB | 2484695 | A | 4/2012 |
| GB | 2484761 | | 4/2012 |
| GB | 2493231 | A | 1/2013 |
| GB | 2493505 | A | 2/2013 |
| GB | 2493507 | A | 2/2013 |
| GB | 2499041 | | 8/2013 |
| GB | 2500005 | | 9/2013 |
| GB | 2500010 | | 9/2013 |
| GB | 2500011 | | 9/2013 |
| GB | 2500012 | | 9/2013 |
| JP | 31-13055 | | 8/1956 |
| JP | 35-4369 | | 3/1960 |
| JP | 39-7297 | | 3/1964 |
| JP | 46-7230 | | 12/1971 |
| JP | 47-21718 | | 10/1972 |
| JP | 49-43764 | | 4/1974 |
| JP | 49-150403 | | 12/1974 |
| JP | 50-92046 | | 8/1975 |
| JP | 51-7258 | | 1/1976 |
| JP | 52-121045 | | 9/1977 |
| JP | 53-60100 | | 5/1978 |
| JP | 56-167897 | | 12/1981 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-98099 | | 5/1987 |
| JP | 62-223494 | | 10/1987 |
| JP | 63-36794 | | 3/1988 |
| JP | 63-179198 | | 7/1988 |
| JP | 63-198933 | | 12/1988 |
| JP | 63-306340 | | 12/1988 |
| JP | 64-21300 | U | 2/1989 |
| JP | 64-58955 | | 3/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-267598 | | 11/1991 |
| JP | 3-286775 | | 12/1991 |
| JP | 4-43895 | | 2/1992 |
| JP | 4-366330 | | 12/1992 |
| JP | 5-99386 | | 4/1993 |
| JP | 5-157093 | | 6/1993 |
| JP | 5-164089 | | 6/1993 |
| JP | 5-263786 | | 10/1993 |
| JP | 6-74190 | | 3/1994 |
| JP | 6-86898 | | 3/1994 |
| JP | 6-147188 | | 5/1994 |
| JP | 6-257591 | | 9/1994 |
| JP | 6-280800 | | 10/1994 |
| JP | 6-336113 | | 12/1994 |
| JP | 7-190443 | | 7/1995 |
| JP | 8-21400 | | 1/1996 |
| JP | 8-72525 | | 3/1996 |
| JP | 8-313019 | | 11/1996 |
| JP | 9-100800 | | 4/1997 |
| JP | 9-178083 | | 7/1997 |
| JP | 9-287600 | | 11/1997 |
| JP | 11-83094 | | 3/1999 |
| JP | 11-502586 | | 3/1999 |
| JP | 11-227866 | | 8/1999 |
| JP | 2000-55419 | | 2/2000 |
| JP | 2000-116179 | | 4/2000 |
| JP | 2000-201723 | | 7/2000 |
| JP | 2001-17358 | | 1/2001 |
| JP | 2002-21797 | | 1/2002 |
| JP | 2002-138829 | | 5/2002 |
| JP | 2002-213388 | | 7/2002 |
| JP | 2003-4265 | | 1/2003 |
| JP | 2003-161473 | | 6/2003 |
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 2006-189221 | | 7/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3144127 | | 8/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | 1371413 | | 10/2009 |
| JP | 2009-275925 | | 11/2009 |
| JP | 1376284 | | 12/2009 |
| JP | 2010-46411 | | 3/2010 |
| JP | 2010-131259 | | 6/2010 |
| JP | 2010-203760 | | 9/2010 |
| JP | 2010-203764 | | 9/2010 |
| JP | 2012-31806 | | 2/2012 |
| KR | 1999-002660 | | 1/1999 |
| KR | 10-2005-0102317 | | 10/2005 |
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M399207 | | 3/2011 |
| TW | M4077299 | | 7/2011 |
| WO | WO 90/13478 | | 11/1990 |
| WO | WO-95/06822 | | 3/1995 |
| WO | WO-02/073096 | | 9/2002 |
| WO | WO 03/058795 | | 7/2003 |
| WO | WO-03/069931 | | 8/2003 |
| WO | WO-2005/050026 | | 6/2005 |
| WO | WO 2005/057091 | | 6/2005 |
| WO | WO-2006/008021 | | 1/2006 |
| WO | WO-2006/012526 | | 2/2006 |
| WO | WO 2007/024955 | | 3/2007 |
| WO | WO 2007/048205 | | 5/2007 |
| WO | WO 2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2011/050041 | A1 | 4/2011 |
| WO | WO-2011/147318 | | 12/2011 |
| WO | WO-2012/006882 | | 1/2012 |
| WO | WO-2012/033517 | | 3/2012 |
| WO | WO-2012/052737 | | 4/2012 |
| WO | WO-2013/014419 | A2 | 1/2013 |
| WO | WO-2013/132218 | | 9/2013 |
| WO | WO-2013/132222 | | 9/2013 |

OTHER PUBLICATIONS

Search Report dated Jun. 14, 2012, directed to GB Application No. 1203895.6; 2 pages.

(56) References Cited

OTHER PUBLICATIONS

Gammack, P. et al., U.S. Office Action mailed Dec. 9, 2010, directed to U.S. Appl. No. 12/203,698; 10 pages.
Gammack, P. et al., U.S. Office Action mailed Jun. 21, 2011, directed to U.S. Appl. No. 12/203,698; 11 pages.
Gammack et al., Office Action mailed Sep. 17, 2012, directed to U.S. Appl. No. 13/114,707; 12 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Gammack, P. et al. U.S. Office Action mailed Oct. 18, 2012, directed to U.S. Appl. No. 12/917,247; pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Staniforth et al., U.S. Office Action mailed Sep. 18, 2014, directed to U.S. Appl. No. 13/559,142; 18 pages.
International Search Report mailed Apr. 19, 2013, directed to International Application No. PCT/GB2013/050327; 4 pages.
Gammack et al., U.S. Office Action mailed Feb. 28, 2013, directed to U.S. Appl. No. 12/945,558; 16 pages.
Gammack et al., U.S. Office Action mailed Jun. 12, 2013, directed to U.S. Appl. No. 12/945,558; 20 pages.
Helps et al., U.S. Office Action mailed Feb. 15, 2013, directed to U.S. Appl. No. 12/716,694; 12 pages.
Gammack et al. , U.S. Office Action mailed May 29, 2013, directed to U.S. Appl. No. 13/588,666; 11 pages.
Gammack et al., U.S. Office Action mailed Sep. 27, 2013, directed to U.S. Appl. No. 13/588,666; 10 pages.
Gammack et al., U.S. Office Action mailed Mar. 14, 2013, directed to U.S. Appl. No. 12/716,740; 15 pages.
Gammack et al., U.S. Office Action mailed Sep. 6, 2013, directed to U.S. Appl. No. 12/716,740; 15 pages.
Gammack et al., U.S. Office Action mailed Apr. 24, 2014, directed to U.S. Appl. No. 12/716,740; 16 pages.
Li et al., U.S. Office Action mailed Oct. 25, 2013, directed to U.S. Appl. No. 13/686,480; 17 pages.
Fitton et al., U.S. Office Action mailed Jun. 13, 2014, directed to U.S. Appl. No. 13/274,998; 11 pages.
Fitton et al., U.S. Office Action mailed Jun. 13, 2014, directed to U.S. Appl. No. 13/275,034; 10 pages.
Gammack et al., U.S. Office Action mailed Feb. 14, 2013, directed to U.S. Appl. No. 12/716,515; 21 pages.
Gammack et al., U.S. Office Action mailed Aug. 19, 2013, directed to U.S. Appl. No. 12/716,515; 20 pages.
Gammack et al., U.S. Office Action mailed Feb. 10, 2014, directed to U.S. Appl. No. 12/716,515; 21 pages.
Gammack et al., U.S. Office Action mailed Sep. 3, 2014, directed to U.S. Appl. No. 13/861,891; 7 pages.
Wallace et al., U.S. Office Action mailed Jun. 7, 2013, directed to U.S. Appl. No. 13/192,223; 30 pages.
Wallace et al., U.S. Office Action mailed Oct. 23, 2013, directed to U.S. Appl. No. 13/192,223; 18 pages.
Dos Reis et al., U.S. Office Action mailed Sep. 23, 2014, directed to U.S. Appl. No. 29/466,240; 9 pages.
Dos Reis et al., U.S. Office Action mailed Sep. 24, 2014, directed to U.S. Appl. No. 29/466,229; 9 pages.
Dos Reis et al., U.S. Office Action mailed Sep. 19, 2014, directed to U.S. Appl. No. 29/466,190; 9 pages.
Mcpherson et al., U.S. Office Action mailed Sep. 19, 2014, directed to U.S. Appl. No. 29/466,094; 8 pages.
Mcpherson et al., U.S. Office Action mailed Sep. 19, 2014, directed to U.S. Appl. No. 29/466,241; 8 pages.
Mcpherson et al., U.S. Office Action mailed Sep. 19, 2014, directed to U.S. Appl. No. 29/466,253; 7 pages.
Dyson et al., U.S. Office Action mailed Sep. 12, 2014, directed to U.S. Appl. No. 29/480,896; 10 pages.
Dyson et al., U.S. Office Action mailed Sep. 12, 2014, directed to U.S. Appl. No. 29/480,915; 9 pages.
Poulton et al., U.S. Office Action mailed Sep. 12, 2014, directed to U.S. Appl. No. 29/480,919; 10 pages.
Deniss. (Sep. 9, 2010) "iFan, The Chinese Clone of the Dyson Air Multiplier," located at <http://chinitech.com/en/chinese-clones/ifan-le-clone-chinois-du-dyson-air-multiplier> visited on Aug. 29, 2014. (6 pages).
Amee. (Mar. 29, 2012) "Breeze Right Bladeless Fan Up to 41% Off," located at <http://madamedeals.com/breeze-right-bladeless-fan-up-to-41-off/> visited on Sep. 3, 2014. (2 pages).
Questel. (Jun. 11, 2014) "Designs-Questel" located at <http://sobjprd.questel.fr/export/QPTUJ214/pdf2/19f053ea-a60f-4c58-9232-c458147a9adf-224304.pdf/> visited on Sep. 4, 2014. (67 pages).
Amazon. "Pisenic Bladeless Fan 16 Inches with Remote Control, Bladeless Fan Air Conditioner 110v, Air Multiplier Table Fans, Green," located at <http://www.amazon.com/Pisenic-Bladeless-Fan-16-Conditioner/dp/B007VC178M%3FSubscriptionid%3DAKIAJYLII7AAJMX7ETAA%26tag%3Dtk78-20%26linkCode%3Dxm2%26camp%3D2025%26creative%3D165953%26creativeASIN%3DB007VC178M#cm_cr_dpwidget> visited on Sep. 2, 2014. (4 pages).
Steiner, L., (May 14, 2013) "Dyson Fan Heater Review: Cozy Up to Dyson Fan Heater,"located at <http://www.vissbiz.com/dyson-fan-heater-review/cozy-up-to-dyson-fan-heater/>visited on Sep. 3, 2014. (3 pages).
Staniforth et al., U.S. Office Action mailed Mar. 17, 2015, directed to U.S. Appl. No. 13/785,787; 18 pages.
Staniforth et al., U.S. Office Action mailed Jun. 4, 2015, directed to U.S. Appl. No. 13/784,430; 17 pages.
Dyson et al., U.S. Office Action mailed May 28, 2015, directed to U.S. Appl. No. 29/460,993; 9 pages.
Dyson et al., U.S. Office Action mailed Apr. 27, 2015, directed to U.S. Appl. No. 29/460,994; 6 pages.
Dyson et al., U.S. Office Action mailed Apr. 24, 2015, directed to U.S. Appl. No. 29/460,990; 6 pages.
Dyson et al., U.S. Office Action mailed Apr. 10, 2015, directed to U.S. Appl. No. 29/460,989; 7 pages.

HUMIDIFYING APPARATUS

REFERENCE TO RELATED APPLICATIONS

This application claims the priority of United Kingdom Application no. 1203895.6, filed Mar. 6, 2012, the entire contents of which are incorporated herein by reference.

FIELD OF THE INVENTION

The present invention relates to a humidifying apparatus. In a preferred embodiment, the present invention provides a humidifying apparatus for generating a flow of moist air and a flow of air for dispersing the moist air within a domestic environment, such as a room, office or the like.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil. An airfoil may be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

Another fan assembly which does not use caged blades to project air from the fan assembly is described in WO 2010/100449. This fan assembly comprises a cylindrical base which also houses a motor-driven impeller for drawing a primary air flow into the base, and a single annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

An inner surface of the nozzle includes a detent for co-operating with a wedge located on an external surface of the base. The detent has an inclined surface which is configured to slide over an inclined surface of the wedge as the nozzle is rotated relative to the base to attach the nozzle to the base.

Opposing surfaces of the detent and the wedge subsequently inhibit rotation of the nozzle relative to the base during use of the fan assembly to prevent the nozzle from becoming inadvertently detached from the base. When a user applies a relatively large rotational force to the nozzle, the detent is arranged to flex out of engagement with the wedge to allow the user to remove the nozzle from the base.

SUMMARY OF THE INVENTION

In a first aspect, the present invention provides a fan assembly comprising a body comprising means for generating an air flow, a nozzle mounted on the body for emitting the air flow, the nozzle defining an opening through which air from outside the fan assembly is drawn by the air emitted from the nozzle, nozzle retaining means for releasably retaining the nozzle on the body, the nozzle retaining means having a first configuration in which the nozzle is retained on the body and a second configuration in which the nozzle is released for removal from the body, and a manually actuable member for effecting movement of the nozzle retaining means from the first configuration to the second configuration.

The provision of a manually actuable member for effecting movement of the nozzle retaining means from the first configuration to the second configuration can allow the nozzle to be rapidly and easily released for removal from the body. Once the nozzle has been released it may be pulled away from the body by a user, for example, for cleaning or replacement.

The nozzle retaining means is preferably biased towards the first configuration so that the nozzle is normally retained on the body. This can allow the fan assembly to be lifted by a user gripping the nozzle without the nozzle becoming accidentally released from the body.

The manually actuable member is preferably movable from a first position to a second position to effect movement of the nozzle retaining means from the first configuration to the second configuration. The manually actuable member may be translated or rotated from the first position to the second position. The manually actuable member may be pivotably moveable between the first and second positions. The fan assembly may comprise biasing means for biasing the manually actuable member towards the first position to reduce the risk of the manually actuable member being moved accidentally to the second position, and so require a user to apply a force to the manually actuable member to overcome the biasing force of the biasing means to move the nozzle retaining means to its second configuration. The biasing means may be in the form of one or more springs, such as a leaf spring or compression spring, or one or more resilient elements.

The manually actuable member is preferably located on the body of the fan assembly. The manually actuable member may be depressible by the user. The manually actuable member may be directly depressible by the user. For example part of the manually actuable member may be in the form of a button which can be pressed by a user. Alternatively, the body may comprise a separate button which is operable to move the manually actuable member to the second position. This can allow the manually actuable member to be located remotely from the external surface of the body and so be located in a more convenient position, or have a more convenient shape, for effecting the movement of the nozzle retaining means from its deployed configuration to its stowed configuration. The button is preferably located on an upper surface of the body to allow a user to apply a downward pressure to the button to overcome the biasing force of the biasing means which urges the manually actuable member towards its first position.

The manually actuable member is preferably in the form of a depressible catch, and so in a second aspect the present invention provides a fan assembly comprising a body comprising means for generating an air flow, a nozzle mounted on the body for emitting the air flow, the nozzle defining an opening through which air from outside the fan assembly is drawn by the air emitted from the nozzle, nozzle retaining means for releasably retaining the nozzle on the body, the nozzle retaining means having a first configuration in which the nozzle is retained on the body and a second configuration in which the nozzle is released for removal from the body, and a depressible catch for effecting movement of the nozzle retaining means from the first configuration to the second configuration.

The catch may be arranged to urge the nozzle away from the body as it moves from the first position to the second position to provide a visual indication to the user that the nozzle has been released for removal from the body.

The fan assembly may comprise catch retention means for releasably retaining the catch in its second position. By maintaining the catch in its second position, the nozzle retaining means may be retained in its second configuration. This can enable the user to release the button to remove the nozzle from the body while the nozzle retaining means is retained its second configuration.

In a third aspect the present invention provides a fan assembly comprising a body comprising means for generating an air flow, a nozzle mounted on the body for emitting the air flow, the nozzle defining an opening through which air from outside the fan assembly is drawn by the air emitted from the nozzle, nozzle retaining means for releasably retaining the nozzle on the body, the nozzle retaining means being moveable from a first configuration in which the nozzle is retained on the body to a second configuration in which the nozzle is released for removal from the body, and retaining means for releasably retaining the nozzle retaining means in the second configuration. The retaining means preferably comprises a moveable catch for retaining the nozzle retaining means in the second configuration. The catch is preferably moveable between a first position and a second position for retaining the nozzle retaining means in the second configuration. The retaining means preferably comprises catch retention means for retaining the catch in the second position.

The catch retention means may comprise one or more magnets for retaining the catch in its second position. Alternatively, the catch retention means may be arranged to engage the catch to retain the catch in its second position. In one embodiment, the catch comprises a hooked section which moves over and is retained by a wedge located on the body as it moves to its second position.

The nozzle preferably comprises means for urging the retaining means away from the second configuration. The nozzle is preferably arranged to urge the catch away from the catch retention means as it is replaced on the body. For example, a lower surface of the nozzle may be formed with, or comprise, a protruding member which urges the catch away from the catch retention means as the nozzle is lowered on to the body. As the catch is moved away from the catch retention means, the catch is urged by the biasing means towards its first position, which can in turn urge the nozzle retaining means towards its first configuration to retain the nozzle on the body.

The nozzle retaining means preferably comprises a detent which is moveable relative to the nozzle and the body to retain the nozzle on the body in the first configuration, and to release the nozzle for removal from the body in the second configuration. The detent may be located on the nozzle, but in a preferred embodiment the body comprises the detent. The catch is preferably configured to move the detent from a first, deployed position to a second, stowed position to release the nozzle for removal from the body.

In a fourth aspect, the present invention provides a fan assembly comprising a body comprising means for generating an air flow, and a nozzle mounted on the body for emitting the air flow, the nozzle defining an opening through which air from outside the fan assembly is drawn by the air emitted from the nozzle, wherein the body comprises a detent which is moveable relative to the nozzle from a first position for retaining the nozzle on the body to a second position for allowing the nozzle to be removed from the body, and a manually actuable member for actuating movement of the detent from the first position to the second position.

The body preferably comprises biasing means for biasing the detent towards the first position. The biasing means is preferably in the form of a leaf spring or a torsion spring, but the biasing means may be in the form of any resilient element.

The detent may be translated or rotated from the first position to the second position. Preferably, the detent is pivotably moveable between the first and second positions. The detent is preferably pivotably connected to the body, but alternatively the detent may be pivotably connected to the nozzle. The catch may be arranged to engage a lower surface of the detent as the catch moves from its first position to the second position to pivot the detent.

The detent is preferably arranged to engage an outer surface of the nozzle to retain the nozzle on the body. For example, the detent may be arranged to engage or enter a recessed portion of the outer surface of the nozzle to retain the nozzle on the body.

The nozzle preferably comprises an inlet section which is at least partially insertable into the body, and the detent may be arranged to engage the inlet section of the nozzle to retain the nozzle on the body. The inlet section of the nozzle is preferably insertable into a duct of the body to receive at least part of the air flow from the body. The duct may comprise an aperture through which the detent protrudes when in its first position to retain the nozzle on the body.

The nozzle retaining means may comprise a single detent. In a preferred embodiment, the nozzle retaining means comprises a plurality of detents, and the manually actuable member may be arranged to move the detents simultaneously between their deployed and stowed positions. The manually actuable member may be curved, arcuate or annular in shape so as to move each of the detents simultaneously. The detents may be located at diametrically opposed positions relative to the duct of the body.

The nozzle is preferably annular in shape, and extends about a bore through which air from outside the fan assembly is drawn by air emitted from the nozzle. The nozzle comprises one or more air outlets for emitting the air flow. The air outlet(s) may be located in or towards a front end of the nozzle, or towards a rear end of the nozzle. The air outlet(s) may comprise a plurality of apertures each for emitting a respective air stream, and each aperture may be located on a respective side of the bore. Alternatively, the nozzle may comprise a single air outlet extending at least partially about the bore. The nozzle may comprise an interior passage extending about the bore for conveying the air flow to the, or each, air outlet. The interior passage may surround the bore of the nozzle.

The fan assembly may be configured to generate a cooling air flow within a room or other domestic environment. However, the fan assembly may be arranged to change a parameter of an air flow emitted from the fan assembly. In an illustrated embodiment, the fan assembly includes humidifying means, or a humidifier, but the fan assembly may alternatively comprise one of a heater, a chiller, an air purifier and an ionizer for changing another parameter of either the first air flow or a second air flow emitted from the fan assembly.

For example, the body may comprise humidifying means for humidifying a second air flow. The body may comprise a base and part of the humidifying means may be housed within or connected to the base. An air inlet and the means for generating an air flow is preferably located in the base of the body. The means for generating an air flow preferably comprises an impeller and a motor for driving the impeller to generate the air flow. The impeller is preferably a mixed flow impeller. The means for generating an air flow preferably comprises a diffuser located downstream from the impeller. The base preferably comprises the duct for conveying the air flow to the nozzle.

In a fifth aspect, the present invention provides humidifying apparatus comprising a body and a nozzle removably mounted on the body, the body comprising means for generating a first air flow and a second air flow, and humidifying means for humidifying the second air flow, the nozzle comprising at least one first air outlet for emitting the first air flow, the nozzle defining an opening through which air from outside the apparatus is drawn by air emitted from said at least one first air outlet, the apparatus comprising at least one second air outlet for emitting the second air flow, wherein the body comprises nozzle retaining means moveable relative to the body for releasably retaining the nozzle on the body.

Part of the humidifying means is preferably located adjacent to the nozzle. Depending on the proximity of the humidifying means to the nozzle, the humidifying means may comprise at least one of the nozzle retaining means, the catch and the catch retention means.

The humidifying means preferably comprises a water tank. The body preferably comprises the water tank and a base upon which the water tank is mounted. The water tank may comprise at least the nozzle retaining means. The water tank may also comprise the catch and the catch retention means. The body preferably comprises a housing for the nozzle retention means, and within which the nozzle retention means is moveable relative to the body. This housing may also house the catch and the catch retention means. A wall of the water tank may provide the catch retention means. Alternatively, the catch retention means may be mounted on or connected to a wall of the water tank. The housing preferably comprises an aperture through which the nozzle retaining means protrudes to retain the nozzle on the body. The water tank is preferably removably mounted on the base. An aperture of the housing of the water tank may therefore align with the aperture on the duct of the base when the water tank is mounted on the base to allow the nozzle retaining means to protrude through both apertures to retain the nozzle.

The water tank may comprise a handle which is moveable between a stowed position and a deployed position to facilitate the removal of the water tank from the base. The water tank may comprise a spring or other resilient element for urging the handle towards the deployed position to present the handle to the user. The nozzle may be configured to urge the handle towards the stowed position, so that when the nozzle is removed from the apparatus the handle moves automatically to the deployed position to facilitate the removal of the water tank from the base.

In a sixth aspect, the present invention provides humidifying apparatus comprising means for generating a first air flow and a second air flow, a removable nozzle comprising at least one first air outlet for emitting the first air flow, the nozzle defining an opening through which air from outside the humidifying apparatus is drawn by air emitted from said at least one first air outlet, humidifying means for humidifying the second air flow, at least one second air outlet for emitting the second air flow, and a water tank having a handle which is moveable between a stowed position and a deployed position, and biasing means for urging the handle towards the deployed position, wherein the nozzle is configured to urge the handle towards the stowed position.

As the nozzle is replaced on the body, the nozzle may engage the handle to move the handle, against the biasing force of the biasing means, towards its stowed position. As the handle moves towards the stowed position, the handle may engage the catch to urge the catch away from the catch retention means to release the catch from its deployed position. The detent is preferably biased towards its deployed position. The release of the catch from its second position can allow the detent to move automatically to its deployed position to retain the nozzle on the body.

The water tank preferably comprises a recessed portion for storing the handle in its stowed position so that the handle does not protrude from the water tank when in its stowed position. The biasing means for biasing the handle towards its deployed position is preferably located in the recessed portion of the water tank. The biasing force is preferably in the form of a leaf spring or a torsion spring, but the biasing means may be in the form of any other spring or resilient member. The handle is preferably pivotably moveable between the stowed position and the deployed position.

The water tank may have a concave inner wall which is locatable adjacent, and preferably against, the duct of the base when the water tank is mounted on the base. To increase the capacity of the water tank, the water tank may be annular in shape. The water tank may therefore have a tubular inner wall which is located over and around at least an upper section of the duct of the base when the water tank is mounted on the base. The water tank may have a cylindrical outer wall. The base preferably has a cylindrical outer wall, and the water tank is preferably located on the base so that the water tank and the base are co-axial. The outer walls of the base and the water tank preferably form the outer wall of the body. The outer wall of the water tank and the outer wall of the base preferably have the same radius so that the body has a cylindrical appearance when the water tank is mounted on the base. The outer walls of the base and the water tank are preferably flush when the water tank is mounted on the base.

To increase further the capacity of the water tank, the water tank preferably surrounds at least an upper part of the means for generating an air flow, which in this example is a motor and impeller unit. Therefore, in a seventh aspect the present invention provides humidifying apparatus comprising a base comprising air flow generating means for generating a first air flow, a nozzle comprising at least one first air outlet for emitting the first air flow, the nozzle defining an opening through which air from outside the humidifying apparatus is drawn by air emitted from said at least one first air outlet, humidifying means for humidifying a second air flow, at least one second air outlet for emitting the second air flow, and a water tank removably mounted on the base, and wherein the water tank surrounds at least an upper section of the air flow generating means.

The nozzle may be mounted on the body so that the water tank surrounds a lower section of the interior passages of the nozzle. For example, the water tank may have an upper wall which is upwardly curved in shape, and the nozzle may be mounted centrally on the body so that the upper wall of the water tank covers a lower part of the external surface of the nozzle. This can allow the humidifying apparatus to have a compact appearance, and can allow the capacity of the water tank to be maximised.

In an eighth aspect, the present invention provides humidifying apparatus comprising a base comprising air flow generating means for generating a first air flow, a nozzle comprising an interior passage for receiving the first air flow and at least one first air outlet for emitting the first air flow, the nozzle defining an opening through which air from outside the apparatus is drawn by air emitted from said at least one first air outlet, humidifying means for humidifying a second air flow, at least one second air outlet for emitting the second air flow, and a water tank mounted on the base, and wherein the tank has an upwardly curved upper surface and the nozzle is mounted on the apparatus so that the upper surface of the water tank at least partially covers a lower section of an external surface of the nozzle.

A water inlet of the water tank is preferably located on a lower surface of the water tank. To fill the water tank, the water tank is removed from the base, and inverted so that the water tank can be located beneath a tap or other water source. The upper surface of the water tank preferably comprises at least one support for supporting the water tank on a work surface, for example between filling and replacement of the water tank on the base. The support(s) may be attached to the upper surface of the water tank. Alternatively, a periphery of the upper surface of the water tank may be shaped to define the support(s). The upper surface of the water tank may comprise a single curved or arcuate support. Alternatively, the upper surface of the water tank may comprise a plurality of supports located on opposite sides of the water tank. The supports are preferably parallel.

The humidifying means preferably comprises a water reservoir for receiving water from the water tank, and atomizing means for atomizing water in the reservoir to humidify the second air flow. The water reservoir and the atomizing means are preferably located in the base. The base preferably comprises an inlet duct for conveying the second air flow to the reservoir. The base may also comprise an outlet duct for conveying the humidified second air flow from the reservoir to the second air outlet(s). Alternatively, the water tank may comprise an outlet duct for conveying the second air flow from the reservoir.

The air flow generating means may comprise a first impeller and a first motor for driving the first impeller to generating the first air flow, and a second impeller for generating the second air flow. The second impeller may be driven by the first motor so that the first and second impellers are always rotated simultaneously. Alternatively, a second motor may be provided for driving the second impeller. This allows the second impeller to be driven to generate the second air flow as and when it is required by the user, and so allows an air flow to emitted from the fan assembly solely through the rear section of the fan. A common controller may be provided for controlling each motor. For example, the controller may be configured to actuate the second motor only if the first motor is currently actuated or if the second motor is actuated simultaneously with the first motor. The second motor may be deactivated automatically if the first motor is deactivated. The controller is thus preferably configured to allow the first motor to be activated separately from the second motor.

Alternatively, the air flow generating means may comprise a motor and an impeller for generating an air stream which is divided into the first air flow and the second air flow downstream from the impeller. The impeller is preferably a mixed flow impeller. An inlet port through which the second air flow enters the inlet duct for conveying the second air flow to the reservoir may be located immediately downstream from the impeller, or immediately downstream from a diffuser located downstream from the impeller.

The outlet duct may be configured to convey the second air flow to the nozzle for emission therefrom. The nozzle may be arranged to emit both a humid air flow, and a separate air flow for conveying the humid air flow away from the humidifying apparatus. This can enable the humid air flow to be experienced rapidly at a distance from the humidifying apparatus.

The nozzle may thus comprise at least one first air inlet, at least one first air outlet, a first interior passage for conveying the first air flow from said at least one first air inlet to said at least one first air outlet, at least one second air inlet, at least one second air outlet, and a second interior passage for conveying the second air flow from said at least one second air inlet to said at least one second air outlet.

The humidified second air flow can be emitted from one or more different air outlets of the nozzle. These air outlets may be positioned, for example, about the bore of the nozzle to allow the humidified air flow to be dispersed relatively evenly within the first air flow.

Preferably, the first air flow is emitted at a first air flow rate and the second air flow is emitted at a second air flow rate which is lower than the first air flow rate. The first air flow rate may be a variable air flow rate, and so the second air flow rate may vary with the first air flow rate.

The first air outlet(s) are preferably located behind the second air outlet(s) so that the second air flow is conveyed away from the nozzle within the first air flow. Each interior passage is preferably annular. The two interior passages of the nozzle may be defined by respective components of the nozzle, which may be connected together during assembly. Alternatively, the interior passages of the nozzle may be separated by a dividing wall or other partitioning member located between inner and outer walls of the nozzle. As mentioned above, the first interior passage is preferably isolated from the second interior passage, but a relatively small amount of air may be bled from the first interior passage to the second interior passage to urge the second air flow through the second air outlet(s) of the nozzle.

As the flow rate of the first air flow is preferably greater than the flow rate of the second air flow, the volume of the first interior passage of the nozzle is preferably greater than the volume of the second interior passage of the nozzle.

The nozzle may comprise a single first air outlet, which preferably extends at least partially about the bore of the nozzle, and is preferably centred on the axis of the bore. Alternatively, the nozzle may comprise a plurality of first air outlets which are arranged about the bore of the nozzle. For example, the first air outlets may be located on opposite sides of the bore. The first air outlet(s) are preferably arranged to emit air through at least a front part of the bore. The first air outlet(s) may be arranged to emit air over a surface defining part of the bore to maximise the volume of air which is drawn through the bore by the air emitted from the first air outlet(s). Alternatively, the first air outlet(s) may be arranged to emit the air flow from an end surface of the nozzle.

The second air outlet(s) of the nozzle may be arranged to emit the second air flow over this surface of the nozzle. Alternatively, the second air outlet(s) may be located in a front end of the nozzle, and arranged to emit air away from the surfaces of the nozzle.

The first air outlet(s) may therefore be located adjacent to the second air outlet(s). The nozzle may comprise a single second air outlet, which may extend at least partially about the axis of the nozzle. Alternatively, the nozzle may comprise a plurality of second air outlets, which may be arranged about the front end of the nozzle. For example, the second air outlets may be located on opposite sides of the front end of the nozzle. Each of the plurality of air outlets may comprise one or more apertures, for example, a slot, a plurality of linearly aligned slots, or a plurality of apertures. The first air outlets may extend parallel to the second air outlets.

Features described above in connection with the first aspect of the invention are equally applicable to each of the second to eighth aspects of the invention, and vice versa.

BRIEF DESCRIPTION OF THE INVENTION

An embodiment of the present invention will now be described, by way of example only, with reference to the accompanying drawings, in which.

DETAILED DESCRIPTION OF THE INVENTION

Figure 1:
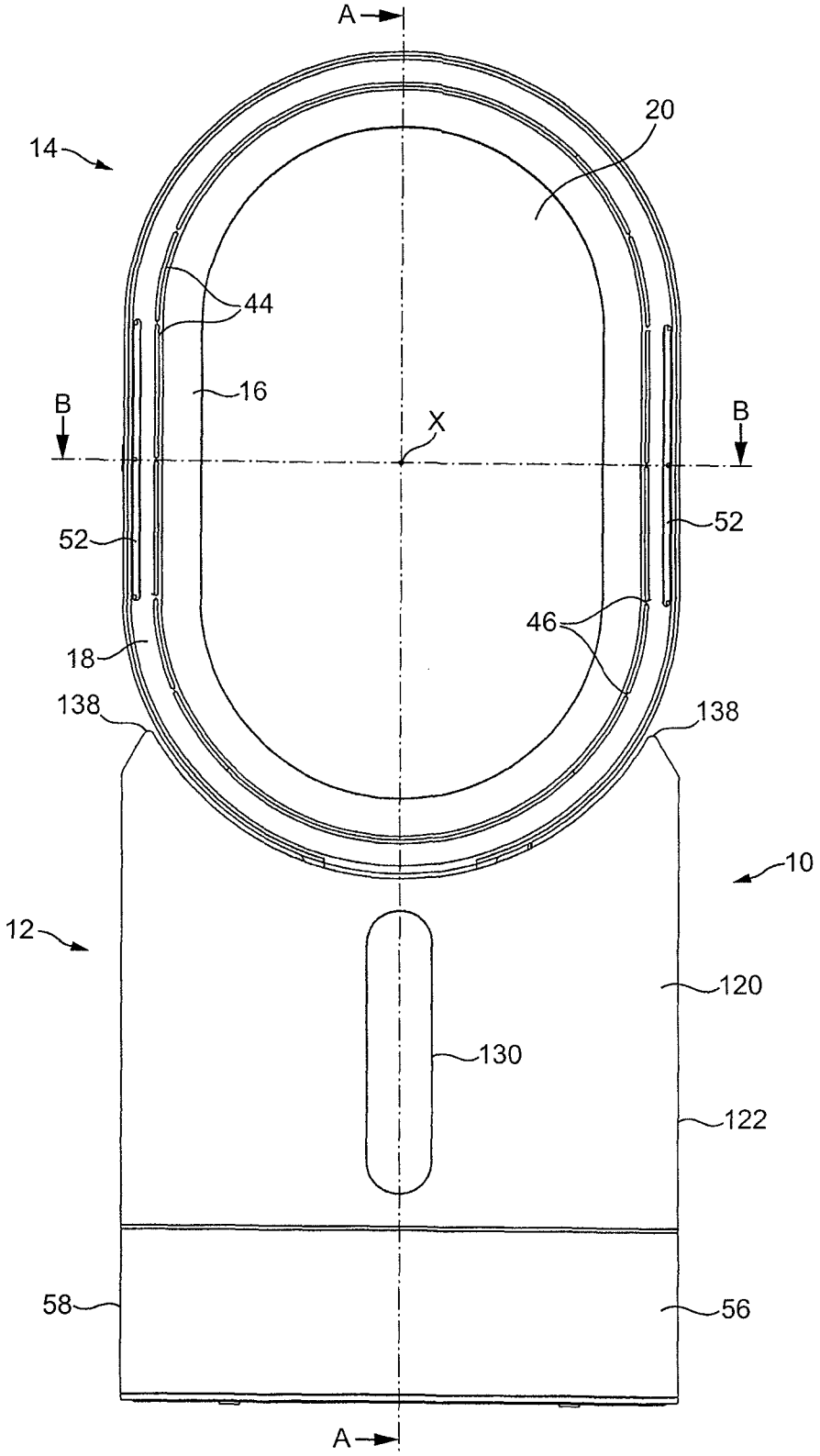
FIG. 1 is a front view of a humidifying apparatus.
Figure 2:
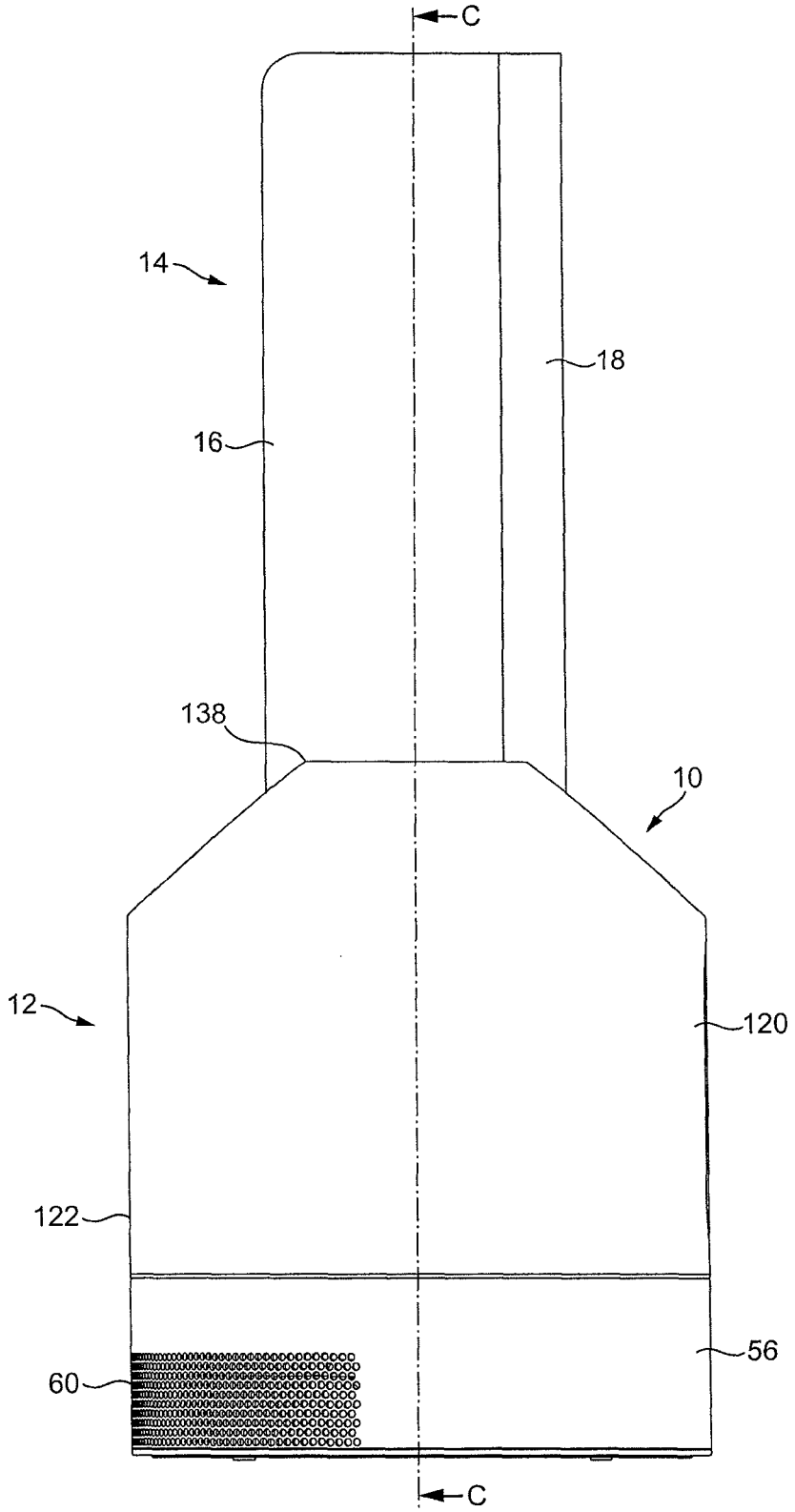
FIG. 2 is a side view of the humidifying apparatus.
Figure 3:
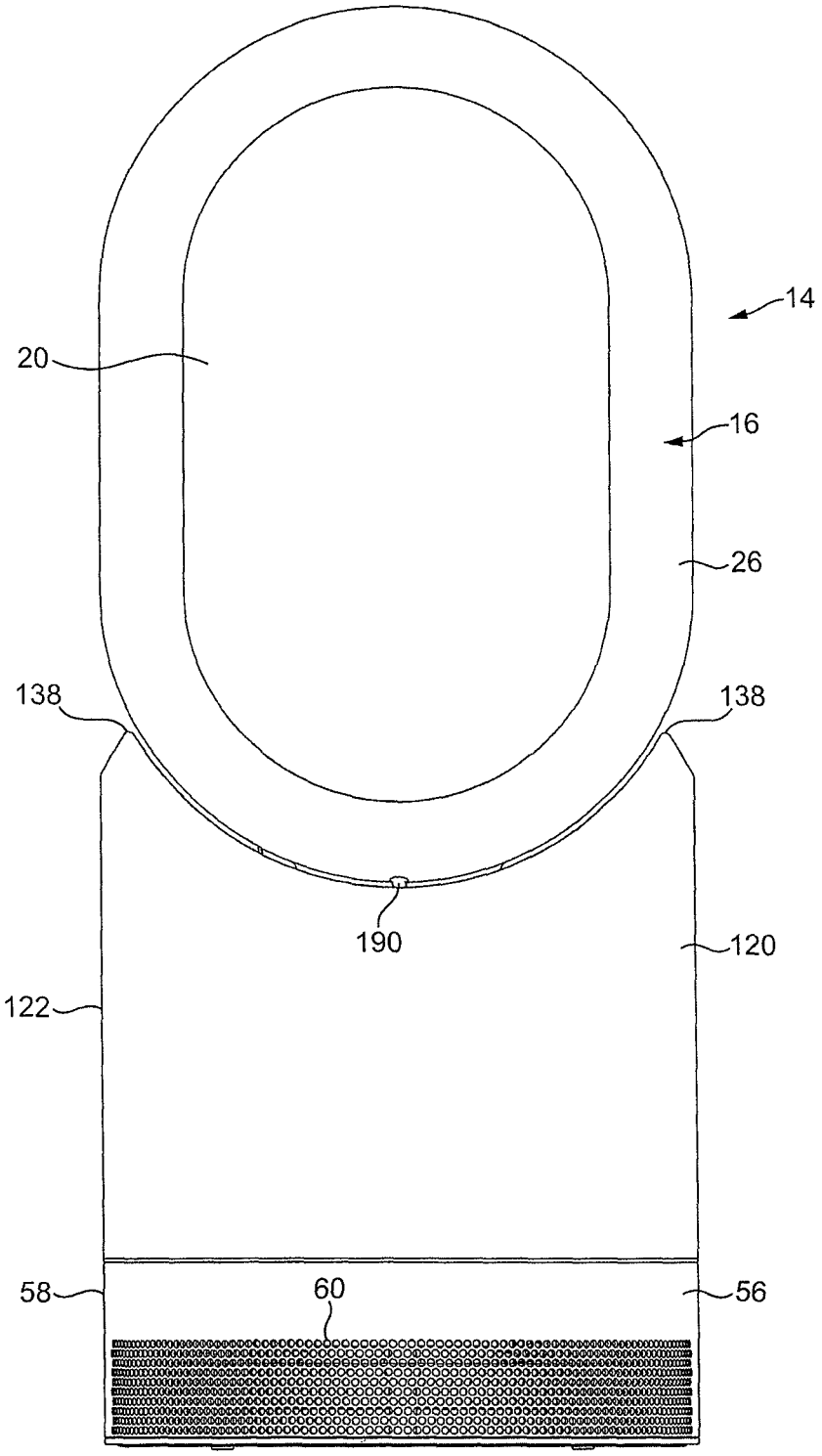
FIG. 3 is a rear view of the humidifying apparatus.

FIGS. 1 to 3 are external views of a fan assembly. In this example, the fan assembly is in the form of a humidifying apparatus 10. In overview, the humidifying apparatus 10 comprises a body 12 comprising an air inlet through which air enters the humidifying apparatus 10, and a nozzle 14 in the form of an annular casing mounted on the body 12, and which comprises a plurality of air outlets for emitting air from the humidifying apparatus 10.

The nozzle 14 is arranged to emit two different air flows. The nozzle 14 comprises a rear section 16 and a front section 18 connected to the rear section 16. Each section 16, 18 is annular in shape, and extends about a bore 20 of the nozzle 14. The bore 20 extends centrally through the nozzle 14 so that the centre of each section 16, 18 is located on the axis X of the bore 20.

In this example, each section 16, 18 has a "racetrack" shape, in that each section 16, 18 comprises two, generally straight sections located on opposite sides of the bore 20, a curved upper section joining the upper ends of the straight sections and a curved lower section joining the lower ends of the straight sections. However, the sections 16, 18 may have any desired shape; for example the sections 16, 18 may be circular or oval. In this embodiment, the height of the nozzle 14 is greater than the width of the nozzle, but the nozzle 14 may be configured so that the width of the nozzle 14 is greater than the height of the nozzle 14.

Each section 16, 18 of the nozzle 14 defines a flow path along which a respective one of the air flows passes. In this embodiment, the rear section 16 of the nozzle 14 defines a first air flow path along which a first air flow passes through the nozzle 14, and the front section 18 of the nozzle 14 defines a second air flow path along which a second air flow passes through the nozzle 14.

Figure 4A:
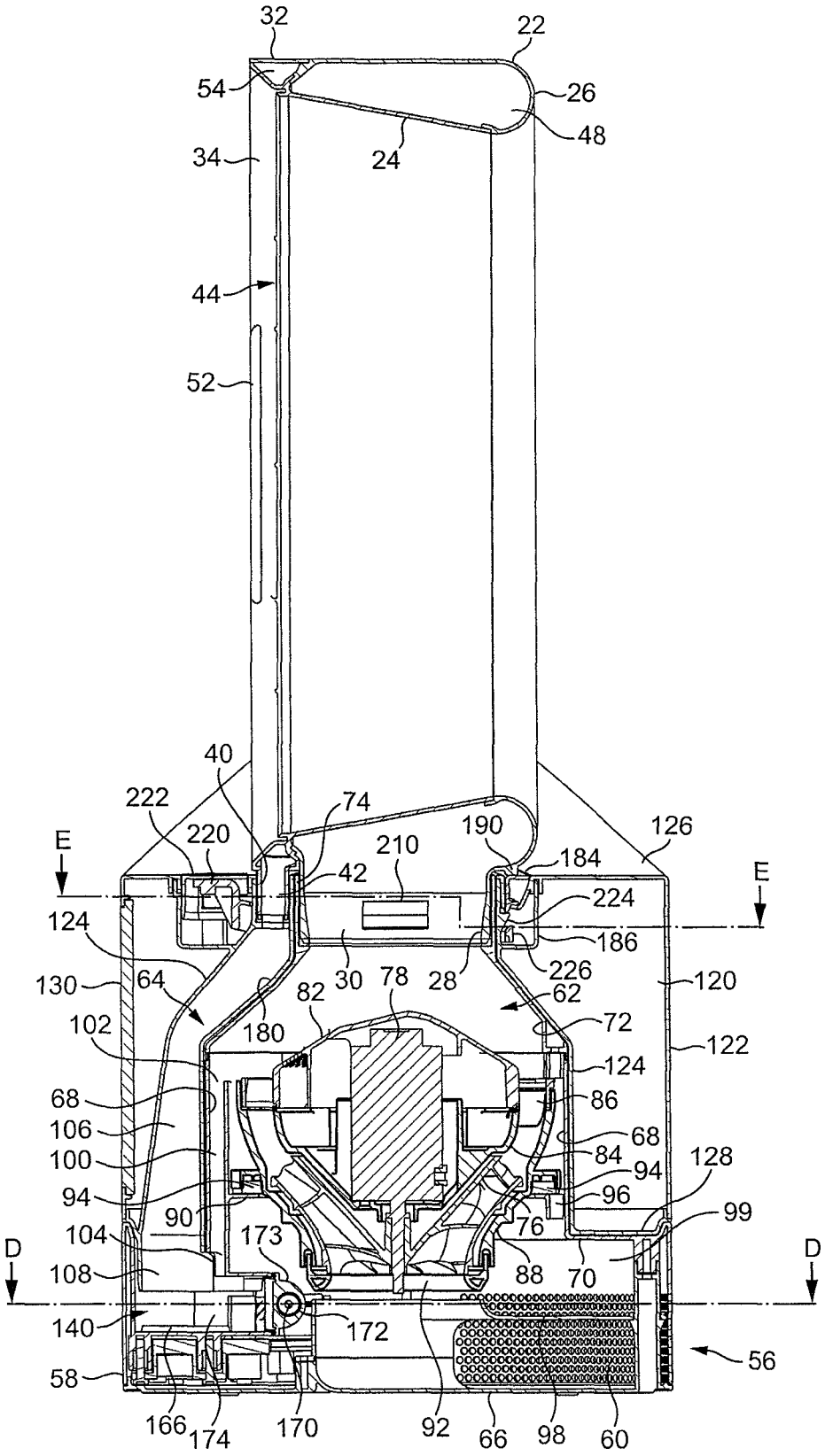
FIG. 4(*a*) is a side sectional view taken along line A-A in FIG. 1, with the nozzle of the humidifying apparatus retained on the body, and FIG. 4(*b*) is a similar view to FIG. 4(*a*) but with the nozzle released from the body.
Figure 4B:
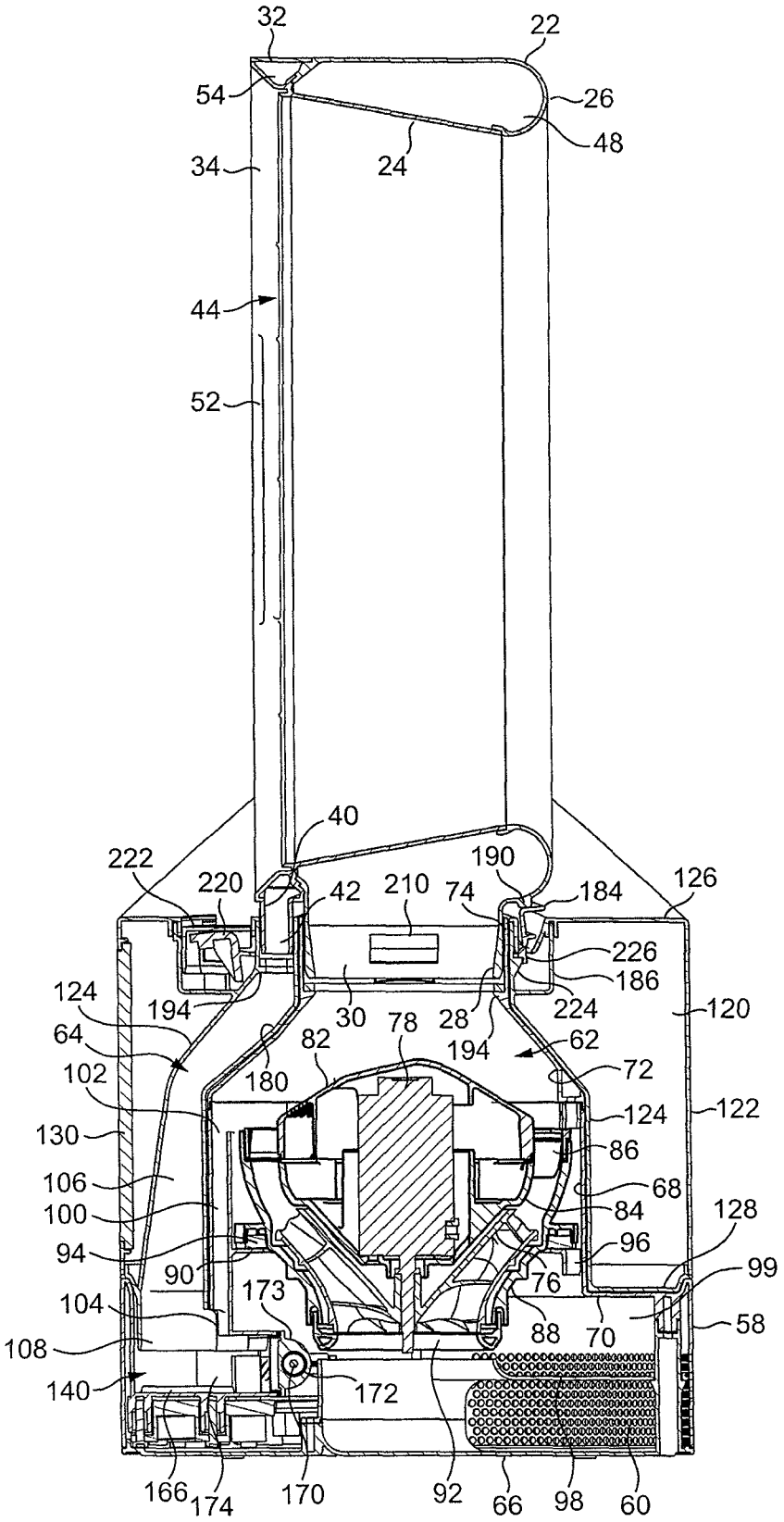
Figure 5B:
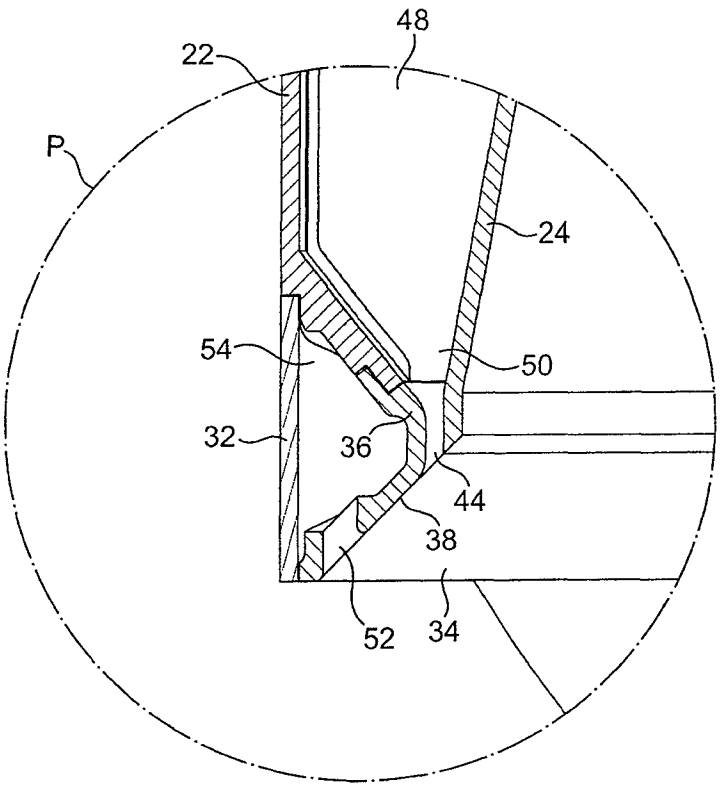
FIG. 5(*a*) is a top sectional view taken along line B-B in FIG. 1, and FIG. 5(*b*) is a close-up of area P indicated in FIG. 5(*a*)
Figure 5A:
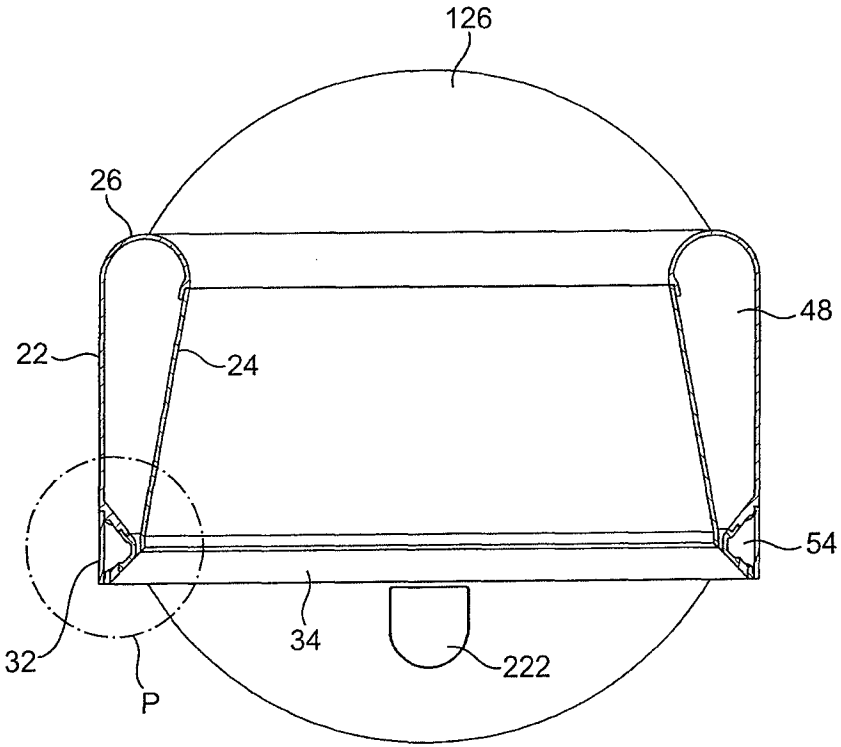

With reference also to FIG. 4(*a*), the rear section 16 of the nozzle 14 comprises an annular first outer casing section 22 connected to and extending about an annular inner casing section 24. Each casing section 22, 24 extends about the bore axis X. Each casing section may be formed from a plurality of connected parts, but in this embodiment each casing section 22, 24 is formed from a respective, single moulded part. As illustrated in FIGS. 5(*a*) and 5(*b*), a rear portion 26 of the first outer casing section 22 is curved inwardly towards the bore axis X to define a rear end of the nozzle 14 and a rear part of the bore 20. During assembly the end of the rear portion 26 of the first outer casing section 22 is connected to the rear end of the inner casing section 24, for example using an adhesive. The first outer casing section 22 comprises a tubular base 28 which defines a first air inlet 30 of the nozzle 14.

The front section 18 of the nozzle 14 also comprises an annular second outer casing section 32 connected to and extending about an annular front casing section 34. Again, each casing section 32, 34 extends about the bore axis X, and may be formed from a plurality of connected parts, but in this embodiment each casing section 32, 34 is formed from a respective, single moulded part. In this example, the front casing section 34 comprises a rear portion 36 which is connected to the front end of the outer casing section 22, and a front portion 38 which is generally frusto-conical in shape and flared outwardly from the rear portion 36 away from the bore axis X. The front casing section 34 may be integral with the inner casing section 24. The second outer casing section 32 is generally cylindrical in shape, and extends between the first outer casing section 22 and the front end of the front casing section 34. The second outer casing section 32 comprises a tubular base 40 which defines a second air inlet 42 of the nozzle 14.

The casing sections 24, 34 together define a first air outlet 44 of the nozzle 14. The first air outlet 44 is defined by overlapping, or facing, surfaces of the inner casing section 24 and the rear portion 36 of the front casing section 34 so that the first air outlet 44 is arranged to emit air from a front end of the nozzle 14. The first air outlet 44 is in the form of an annular slot, which has a relatively constant width in the range from 0.5 to 5 mm about the bore axis X. In this example the first air outlet 44 has a width of around 1 mm. Where the inner casing sections 24, 34 are formed from respective components, spacers 46 may be spaced along the first air outlet 44 for urging apart the overlapping portions of the casing sections 24, 34 to control the width of the first air outlet 44. These spacers may be integral with either of the casing sections 24, 34. Where the casing sections 24, 34 are formed from a single component, the spacers 46 are replaced by fins which are spaced along the first air outlet 44 for connecting together the inner casing section 24 and the front casing section 34.

The nozzle 14 defines an annular first interior passage 48 for conveying the first air flow from the first air inlet 30 to the first air outlet 44. The first interior passage 48 is defined by the internal surface of the first outer casing section 22 and the internal surface of the inner casing section 24. A tapering, annular mouth 50 guides the first air flow to the first air outlet 44. The tapering shape of the mouth 50 provides for a smooth, controlled acceleration of air as it passes from the first interior passage 48 to the first air outlet 44. A first air flow path through the nozzle 14 may therefore be considered to be formed from the first air inlet 30, the first interior passage 48, the mouth 50 and the first air outlet 40.

The front casing section 34 defines a plurality of second air outlets 52 of the nozzle 14. The second air outlets 52 are also formed in the front end of the nozzle 14, each on a respective side of the bore 20, for example by moulding or machining. Each of the second air outlets 52 is located downstream from the first air outlet 44. In this example, each second air outlet 52 is in the form of a slot having a relatively constant width in the range from 0.5 to 5 mm. In this example each second air outlet 52 has a width of around 1 mm. Alternatively, each second air outlet 52 may be in the form of a row of circular apertures or slots formed in the front casing section 34 of the nozzle 14.

The nozzle 14 defines an annular second interior passage 54 for conveying the second air flow from the second air inlet 42 to the second air outlets 52. The second interior passage 54 is defined by the internal surfaces of the casing sections 32, 34, and by the front part of the external surface of the first outer casing section 22. The second interior passage 54 is isolated within the nozzle 14 from the first interior passage 48. A second air flow path through the nozzle 14 may therefore be considered to be formed by the second air inlet 42, the second interior passage 54 and the second air outlets 52.

Returning to FIG. 4(*a*) the body 12 is generally cylindrical in shape. The body 12 comprises a base 56. The base 56 has an external outer wall 58 which is cylindrical in shape, and which comprises an air inlet 60. In this example, the air inlet 60 comprises a plurality of apertures formed in the outer wall 58 of the base 56. A front portion of the base 56 may comprise a user interface of the humidifying apparatus 10. The user interface is illustrated schematically in FIG. 13, and described in more detail below. A mains power cable (not shown) for supplying electrical power to the humidifying apparatus 10 extends through an aperture formed in the base 56.

The base 56 comprises a first air passageway 62 for conveying a first air flow to the first air flow path through the nozzle 14, and a second air passageway 64 for conveying a second air flow to the second air flow path through the nozzle 14.

Figure 6B:
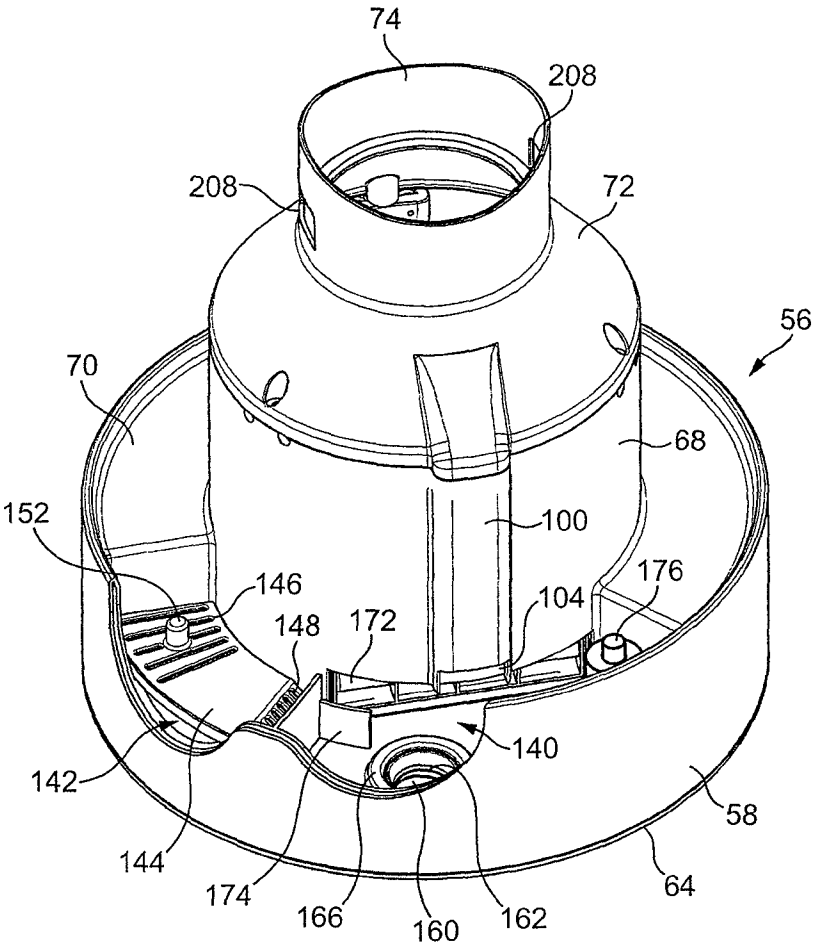
FIG. 6(*a*) is a perspective view, from above, of the base of the humidifying apparatus with an outer wall of the base partially removed, and FIG. 6(*b*) is a similar view to FIG. 6(*a*) following a partial rotation of the base.
Figure 6A:
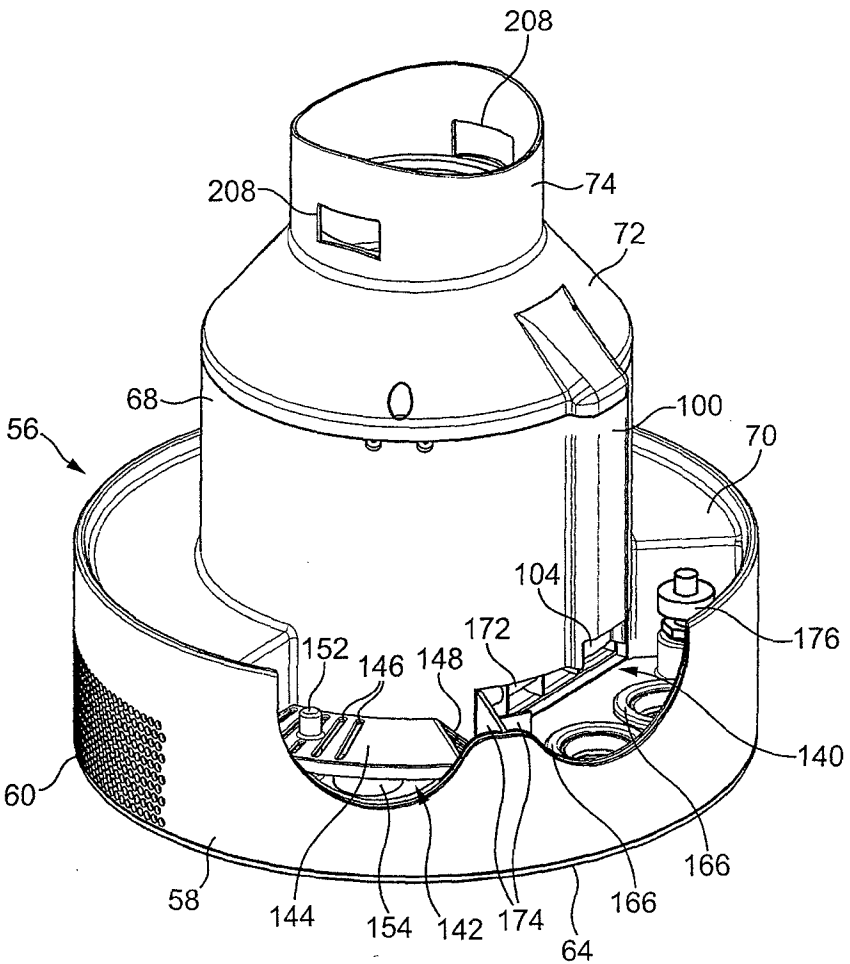

The first air passageway 62 passes through the base 56 from the air inlet 60 to the first air inlet 30 of the nozzle 14. With reference also to FIGS. 6(*a*) and 6(*b*), the base 56 comprises a bottom wall 66 connected to the lower end of the outer wall 58, and a generally cylindrical inner wall 68 connected to the outer wall 58 by a recessed annular wall 70. The inner wall 68 extends upwardly away from the annular wall 70. In this example, the outer wall 58, inner wall 68 and annular wall 70 are formed as a single component of the base 56, but alternatively two or more of these walls may be formed as a respective component of the base 56. An upper wall is connected to the upper end of the inner wall 68. The upper wall has a lower frusto-conical section 72 and an upper cylindrical section 74 into which the base 28 of the nozzle 14 is inserted.

The inner wall 68 extends about an impeller 76 for generating a first air flow through the first air passageway 62. In this example the impeller 76 is in the form of a mixed flow impeller. The impeller 76 is connected to a rotary shaft extending outwardly from a motor 78 for driving the impeller 76. In this embodiment, the motor 78 is a DC brushless motor having a speed which is variable by a drive circuit 80 in response to a speed selection by a user. The maximum speed of the motor 78 is preferably in the range from 5,000 to 10,000 rpm. The motor 78 is housed within a motor bucket comprising an upper portion 82 connected to a lower portion 84. The upper portion 82 of the motor bucket comprises a diffuser 86 in the form of a stationary disc having curved blades. The diffuser 86 is located beneath the first air inlet 30 of the nozzle 14.

The motor bucket is located within, and mounted on, a generally frusto-conical impeller housing 88. The impeller housing 88 is, in turn, mounted on an annular support 90 extending inwardly from the inner wall 68. An annular inlet member 92 is connected to the bottom of the impeller housing 88 for guiding the air flow into the impeller housing 88. An annular sealing member 94 is located between the impeller housing 88 and the annular support 90 to prevent air from passing around the outer surface of the impeller housing 88 to the inlet member 92. The annular support 90 preferably comprises a guide portion 96 for guiding an electrical cable from the drive circuit 80 to the motor 78. The base 56 also includes a guide wall 98 for guiding air flow the air inlet 60 to an air inlet port of the inlet member 92.

The first air passageway 62 extends from the air inlet 60 to the air inlet port of the inlet member 92. The first air passageway 62 extends, in turn, through the impeller housing 88, the upper end of the inner wall 68 and the sections 72, 74 of the upper wall.

An annular cavity 99 is located between the guide wall 98 and the annular wall 70. The cavity 99 has an opening which is located between the inlet member 92 and the guide wall 98 so that the cavity 99 is open to the first air passageway 62. The cavity 99 contains a static pocket of air which serves to reduce the transmission of vibrations generated during use of the humidifying apparatus 10 to the outer surface of the body 12.

The second air passageway 64 is arranged to receive air from the first air passageway 62. The second air passageway 64 is located adjacent to the first air passageway 62. The second air passageway 64 comprises an inlet duct 100. With reference to FIGS. 6(*a*) and 6(*b*), the inlet duct 100 is defined by the inner wall 68 of the base 56. The inlet duct 100 is located adjacent to, and in this example radially external of, part of the first air passageway 62. The inlet duct 100 extends generally parallel to the longitudinal axis of the base 56, which is co-linear with the rotational axis of the impeller 76. The inlet duct 100 has an inlet port 102 located downstream from, and radially outward from, the diffuser 86 so as to receive part of the air flow emitted from the diffuser 86, and which forms the second air flow. The inlet duct 100 has an outlet port 104 located at the lower end thereof.

The second air passageway 64 further comprises an outlet duct 106 which is arranged to convey the second air flow to the second air inlet 42 of the nozzle 14. The second air flow is conveyed through the inlet duct 100 and the outlet duct 106 in generally opposite directions. The outlet duct 106 comprises an inlet port 108 located at the lower end thereof, and an outlet port located at the upper end thereof. The base 40 of the second outer casing section 32 of the nozzle 14 is inserted into the outlet port of the outlet duct 106 to receive the second air flow from the outlet duct 106.

The humidifying apparatus 10 is configured to increase the humidity of the second air flow before it enters the nozzle 14. With reference now to FIGS. 1 to 4(*a*) and FIG. 7, the humidifying apparatus 10 comprises a water tank 120 removably mountable on the base 56. The base 56 and the water tank 120 together form the body 12 of humidifying apparatus 10. The water tank 120 has a cylindrical outer wall 122 which has the same radius as the outer wall 58 of the base 56 of the body 12 so that the body 12 has a cylindrical appearance when the water tank 120 is mounted on the base 56. The water tank 120 has a tubular inner wall 124 which surrounds the walls 68, 72, 74 of the base 56 when the water tank 120 is mounted on the base 56. The outer wall 122 and the inner wall 124 define, with an annular upper wall 126 and an annular lower wall 128 of the water tank 120, an annular volume for storing water. The water tank 120 thus surrounds the impeller 76 and the motor 78, and so at least part of the first air passageway 62, when the water tank 120 is mounted on the base 56. The lower wall 128 of the water tank 120 engages the outer wall 58 of the base 56, and non-recessed parts of the annular wall 70, when the water tank 120 is mounted on the base 56.

The water tank 120 preferably has a capacity in the range from 2 to 4 liters. A window 130 is provided on the outer wall 122 of the water tank 120 to allow a user to see the level of water within the water tank 120 when it is disposed on the base 56.

Figure 9:
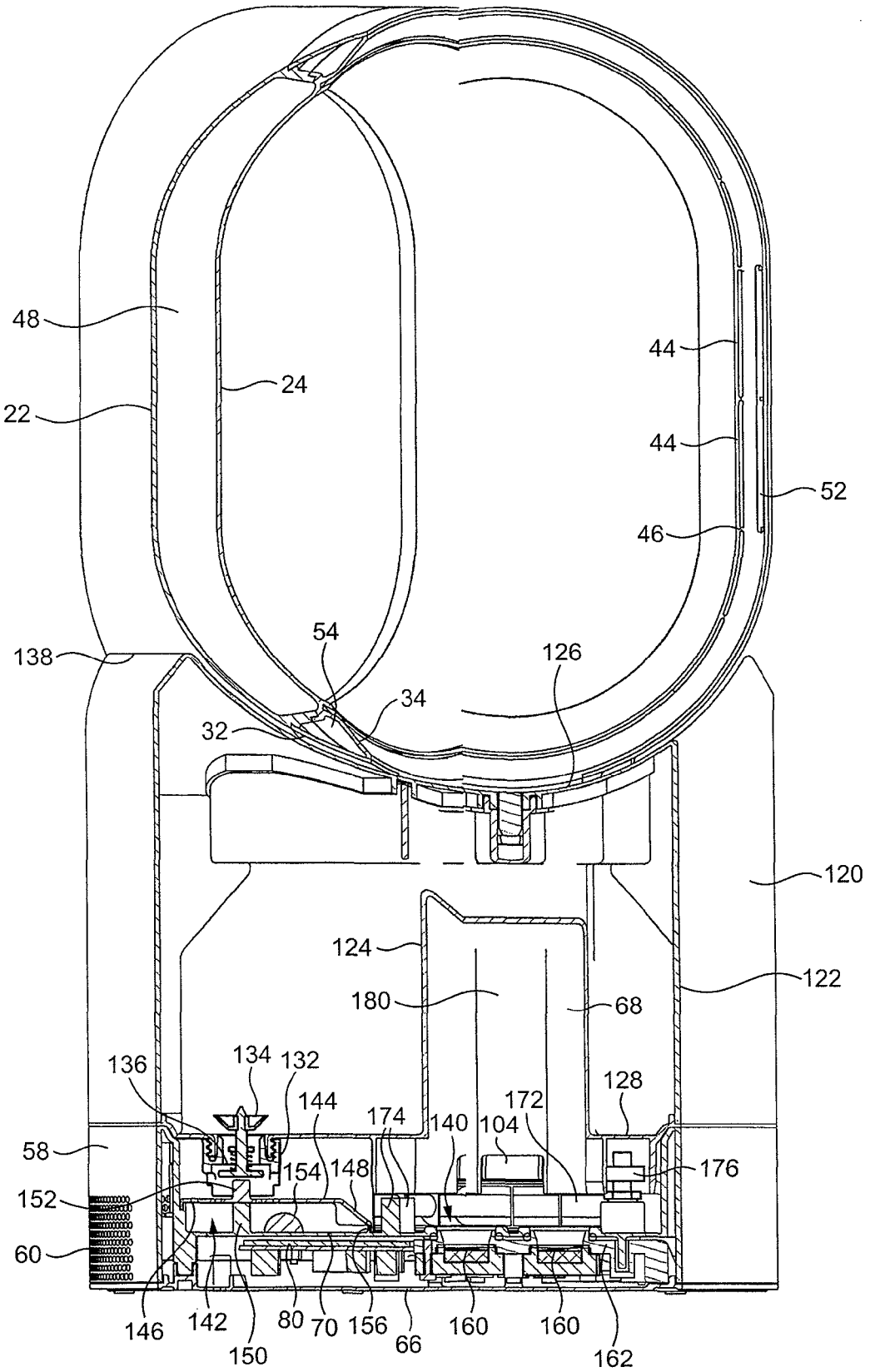
FIG. 9 is a sectional view take along line F-F in FIG. 8.

With reference to FIG. 9, a spout 132 is removably connected to the lower wall 128 of the water tank 120, for example through co-operating threaded connections. In this example the water tank 120 is filled by removing the water tank 120 from the base 56 and inverting the water tank 120 so that the spout 132 is projecting upwardly. The spout 132 is then unscrewed from the water tank 120 and water is introduced into the water tank 120 through an aperture exposed when the spout 132 is disconnected from the water tank 120. Once the water tank 120 has been filled, the user reconnects the spout 132 to the water tank 120, returns the water tank 120 to its non-inverted orientation and replaces the water tank 120 on the base 56. A spring-loaded valve 134 is located within the spout 132 for preventing leakage of water through a water outlet 136 of the spout 132 when the water tank 120 is re-inverted. The valve 134 is biased towards a position in which a skirt of the valve 134 engages the upper surface of the spout 132 to prevent water entering the spout 132 from the water tank 120.

The upper wall 126 of the water tank 120 comprises one or more supports 138 for supporting the inverted water tank 120 on a work surface, counter top or other support surface. In this example, two parallel supports 138 are formed in the periphery of the upper wall 126 for supporting the inverted water tank 120.

With reference also to FIGS. 6(*a*), 6(*b*) and 8, the outer wall 58, inner wall 68 and the recessed portion of the annular wall 70 of the base 56 define a water reservoir 140 for receiving water from the water tank 120. The base 56 comprises a water treatment chamber 142 for treating water from the water tank 120 before it enters the water reservoir 140. The water treatment chamber 142 is located to one side of the water reservoir 140, within the recessed portion of the annular wall 70. A cover 144 connected to the annular wall 70 comprises a water inlet 146 and a water outlet 148 of the water treatment chamber 142. In this embodiment, each of the water inlet 146 and the water outlet 148 comprises a plurality of apertures. Water outlet 148 is located on an inclined surface of the cover 144 so that the water outlet 148 is located beneath the water inlet 146. The cover 144 is supported by a supporting pin 150 which extends upwardly from the annular wall 70 to engage the lower surface of the cover 144.

An upwardly extending pin 152 of the cover 144 is located between apertures of the water inlet 146. When the water tank 120 is mounted on the base 56, the pin 152 protrudes into the spout 132 to push the valve 134 upwardly to open the spout 132, thereby allowing water to pass under gravity through the water inlet 146 and into the water treatment chamber 142. As the water treatment chamber 142 fills with water, water flows through the water outlet 148 and into the water reservoir 140. The water treatment chamber 142 houses a threshold inhibitor, such one or more beads or pellets 154 of a polyphosphate material, which becomes added to the water as it passes through the water treatment chamber 142. Providing the threshold inhibitor in a solid form means that the threshold inhibitor slowly dissolves with prolonged contact with water in the water treatment chamber 142. In view of this, the water treatment chamber 142 comprises a barrier which prevents relatively large pieces of the threshold inhibitor from entering the water reservoir 140. In this example, the barrier is in the form of a wall 156 located between the annular wall 70 and the water outlet 148.

Within the water reservoir 140, the annular wall 70 comprises a pair of circular apertures each for exposing a respective piezoelectric transducer 160. The drive circuit 80 is configured to actuate vibration of the transducers 160 in an atomization mode to atomise water located in the water reservoir 140. In the atomization mode, the transducers 160 may vibrate ultrasonically at a frequency $f_1$, which may be in the range from 1 to 2 MHz. A metallic heat sink 162 is located between the annular wall 70 and the transducers 160 for conveying heat away from the transducers 160. Apertures 164 are formed in the bottom wall 64 of the base 56 to dissipate heat radiated from the heat sink 162. Annular sealing members form water-tight seals between the transducers 160 and the heat sink 162. As illustrated in FIGS. 6(*a*) and 6(*b*), the peripheral portions 166 of the apertures in the annular wall 70 are raised to present a barrier for preventing any particles of the threshold inhibitor which have entered the water reservoir 140 from the water treatment chamber 142 from becoming lodged on the exposed surfaces of the transducers 160.

The water reservoir 140 also includes an ultraviolet radiation (UV) generator for irradiating water stored in the water reservoir 140. In this example, the UV generator is in the form of a UV lamp 170 located within a UV transparent tube 172 located in the water reservoir 140 so that, as the water reservoir 140 fills with water, water surrounds the tube 172. The tube 172 is located on the opposite side of the water reservoir 140 to the transducers 160. One or more reflective surfaces 173 may be provided adjacent to, and preferably about, the tube 172 for reflecting ultraviolet radiation emitted from the UV lamp 170 into the water reservoir 140. The water reservoir 140 comprises baffle plates 174 which guide water entering the water reservoir 140 from the water treatment chamber 142 along the tube 172 so that, during use, the water entering the water reservoir 140 from the water treatment chamber 142 is irradiated with ultraviolet radiation before it is atomized by one of the transducers 160.

A magnetic level sensor 176 is located within the water reservoir 140 for detecting the level of water within the water reservoir 140. Depending on the volume of water within the water tank 120, the water reservoir 140 and the water treatment chamber 142 can be filled with water to a maximum level which is substantially co-planar with the upper surface of the pin 152. The outlet port 104 of the inlet duct 100 is located above the maximum level of water within the water reservoir 140 so that the second air flow enters the water reservoir 140 over the surface of the water located in the water reservoir 140.

The inlet port 108 of the outlet duct 106 is positioned above the transducers 160 to receive a humidified air flow from the water reservoir 140. The outlet duct 106 is defined by the water tank 120. The outlet duct 106 is formed by the inner wall 124 of the water tank 120 and a curved wall 180 about which the inner wall 124 extends.

Figure 7B:
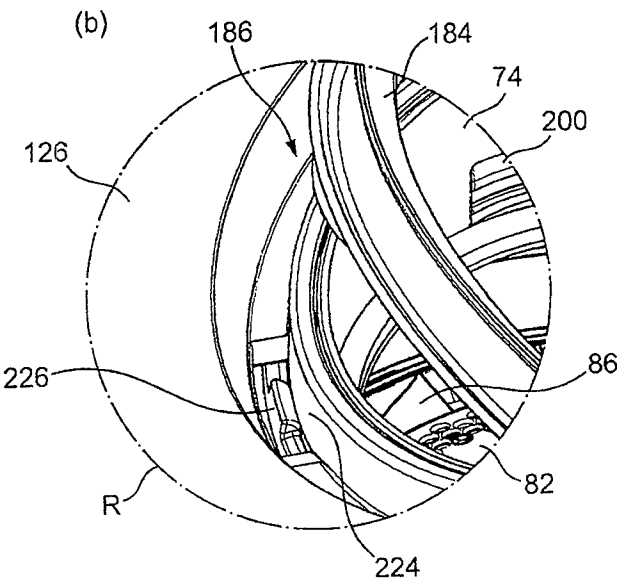
FIG. 7(*a*) is a perspective rear view, from above, of the water tank mounted on the base, with the handle in a deployed position, and FIG. 7(*b*) is a close-up of area R indicated in FIG. 7(*a*)
Figure 7A:
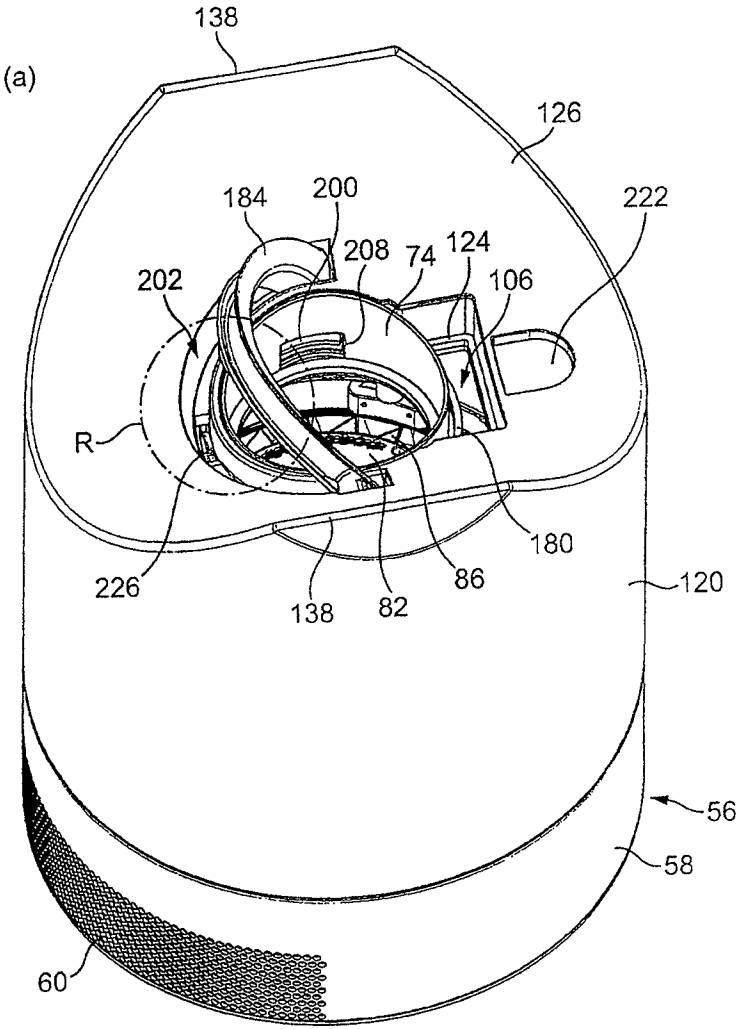
Figure 8:
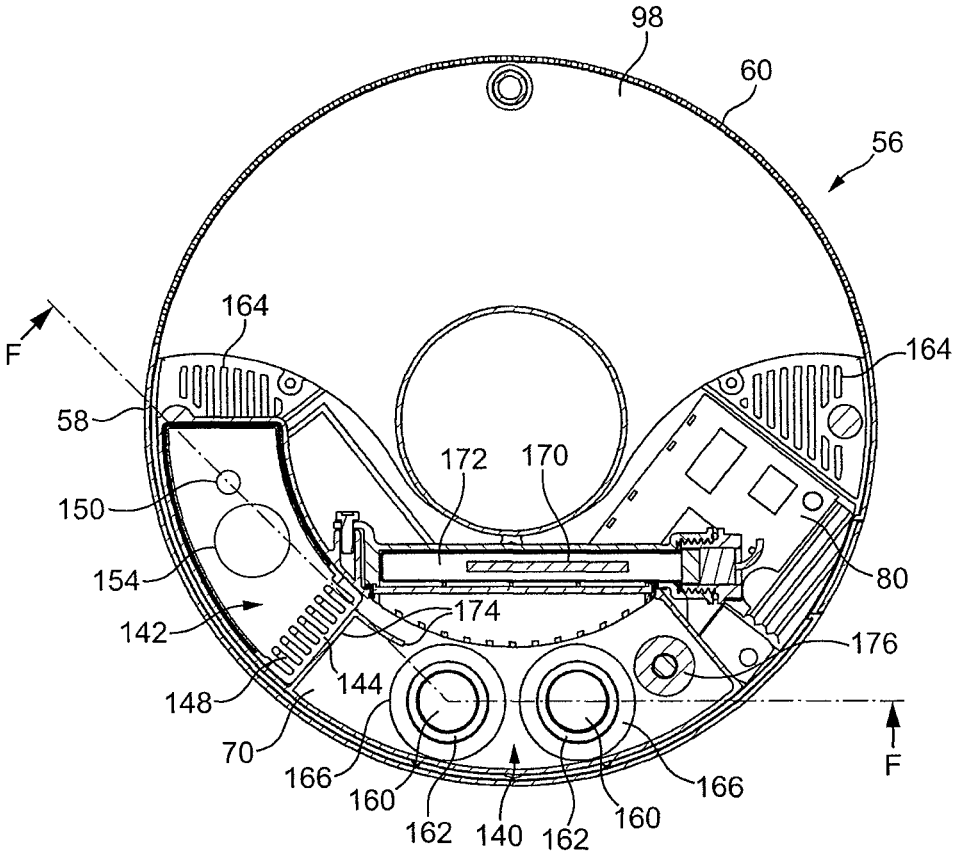
FIG. 8 is a top sectional view taken along line D-D in FIG. 4(*a*)
Figure 12A:
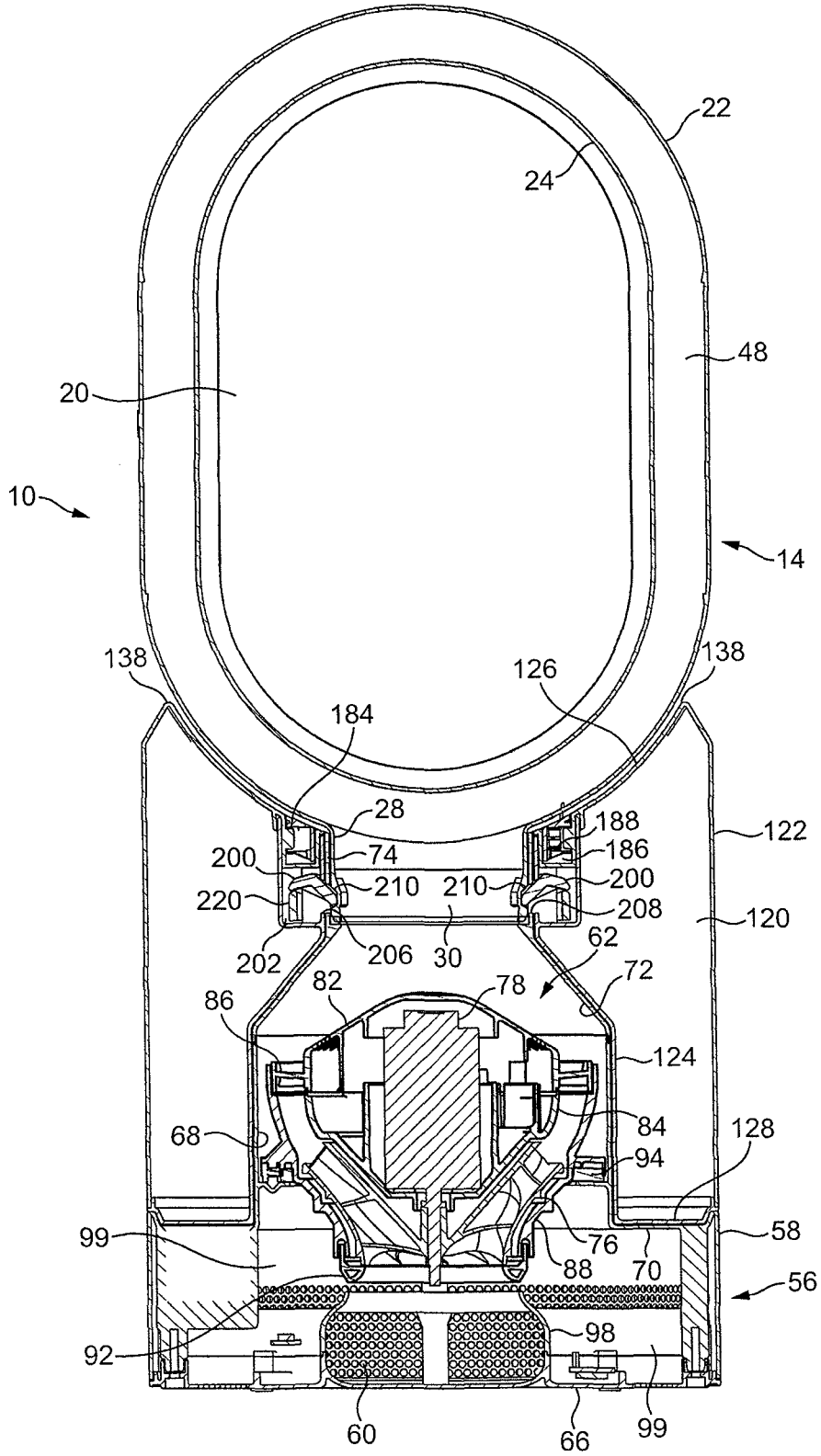
FIG. 12(*a*) is a front sectional view taken along line C-C in FIG. 2, with the nozzle of the humidifying apparatus retained on the body, and FIG. 12(*b*) is a similar view to FIG. 12(*a*) but with the nozzle released from the body.
Figure 12B:
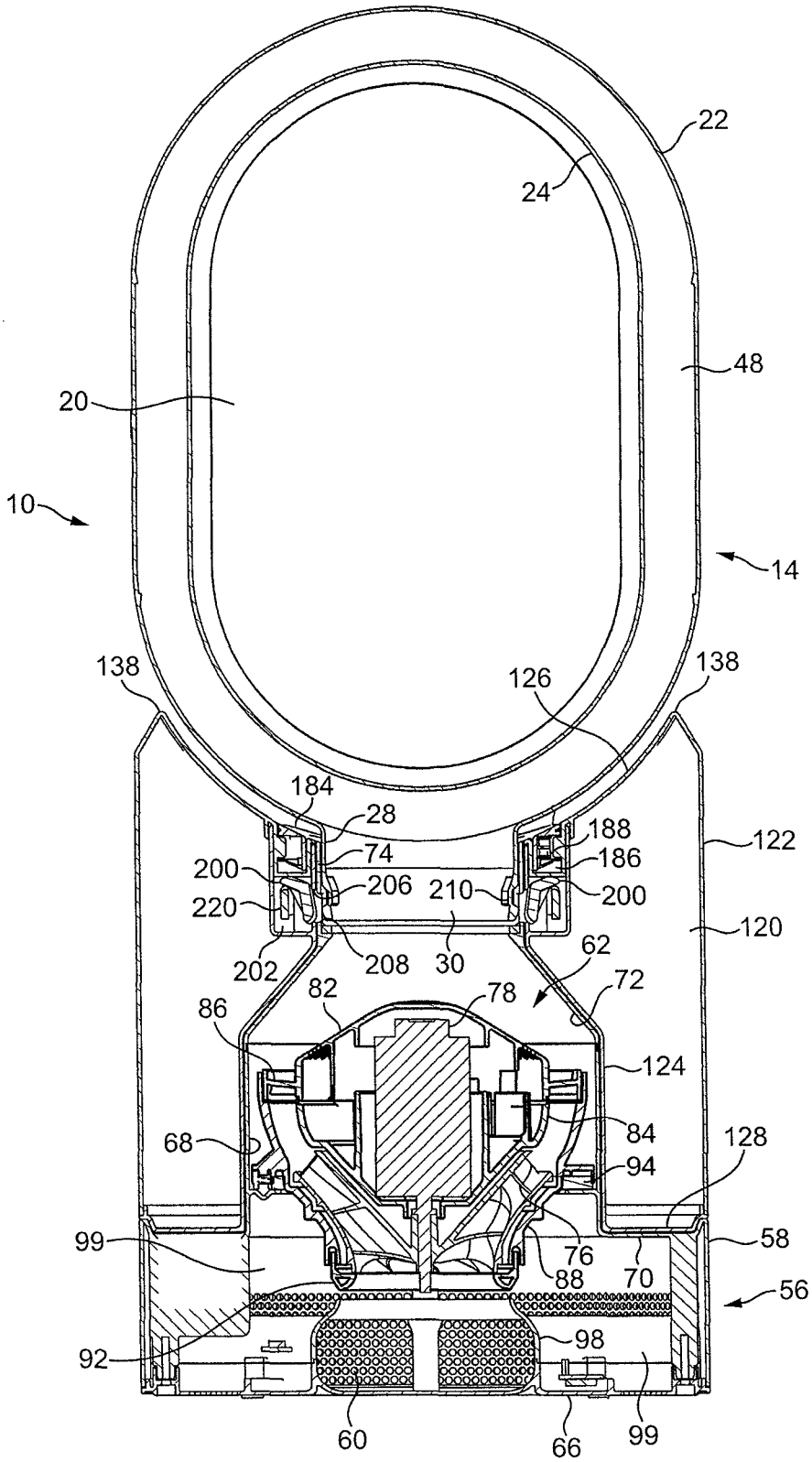

The base 56 includes a proximity sensor 182 for detecting that the water tank 120 has been mounted on the base 56. The proximity sensor 182 is illustrated schematically in FIG. 13. The proximity sensor 182 may be in the form of a reed switch which interacts with a magnet (not shown) located on the lower wall 128 of the water tank 120 to detect the presence, or absence, of the water tank 120 on the base 56. As illustrated in FIGS. 7(*a*), 7(*b*) and 11, when the water tank 120 is mounted on the base 56 the inner wall 124 and the curved wall 180 surround the upper wall of the base 56 to expose the open upper end of the upper cylindrical section 74 of the upper wall. The water tank 120 includes a handle 184 to facilitate removal of the water tank 120 from the base 56. The handle 184 is pivotably connected to the water tank 120 so as to be moveable relative to the water tank 120 between a stowed position, in which the handle 184 is housed within a recessed section 186 of the upper wall 126 of the water tank 120, and a deployed position, in which the handle 184 is raised above the upper wall 126 of the water tank 120. With reference also to FIGS. 12(*a*) and 12(*b*), one or more resilient elements 188, such as torsion springs, may be provided for biasing the handle 184 towards its deployed position, as illustrated in FIGS. 7(*a*) and 7(*b*).

Figure 10:
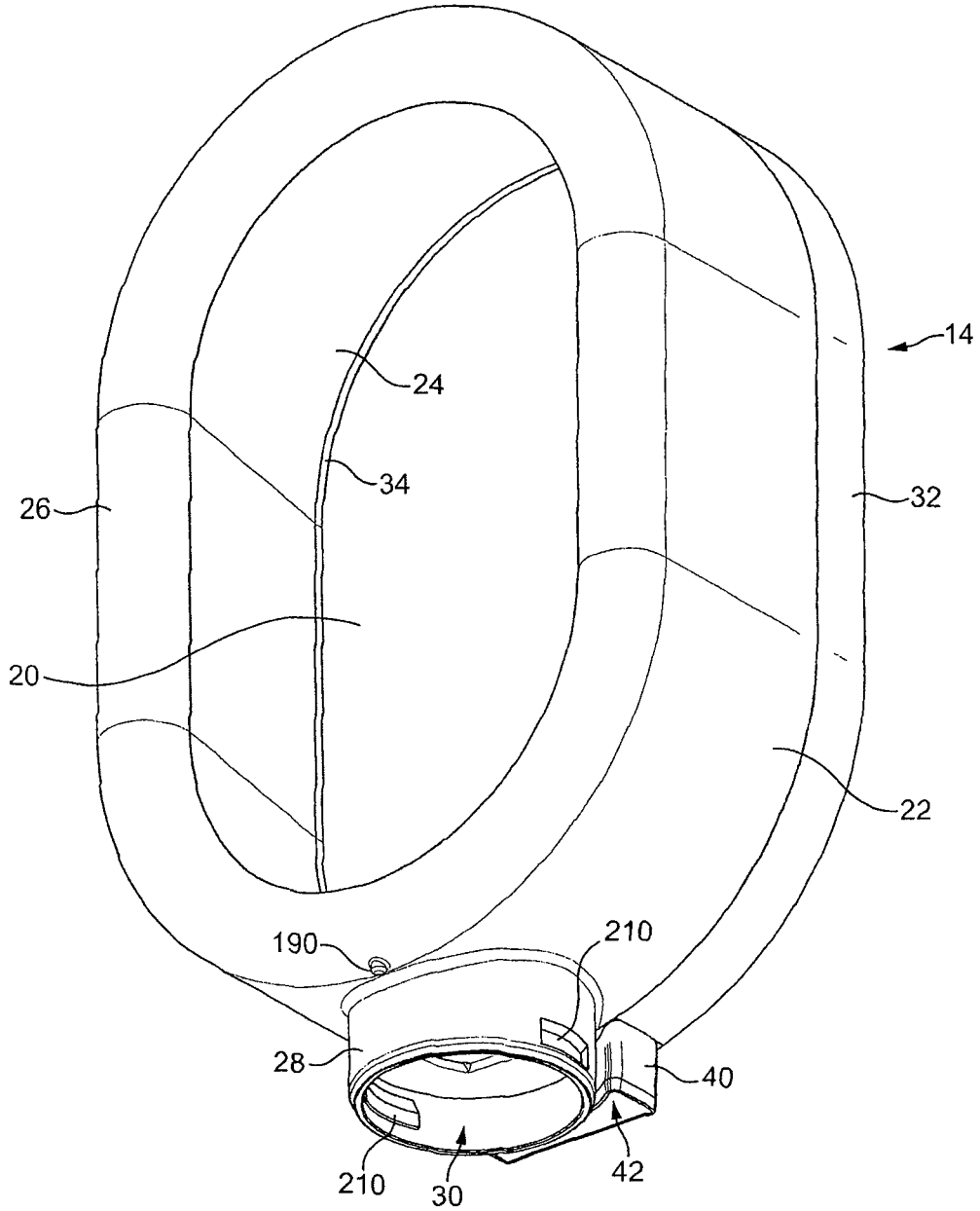
FIG. 10 is a rear perspective view, from below, of the nozzle.
Figure 11:
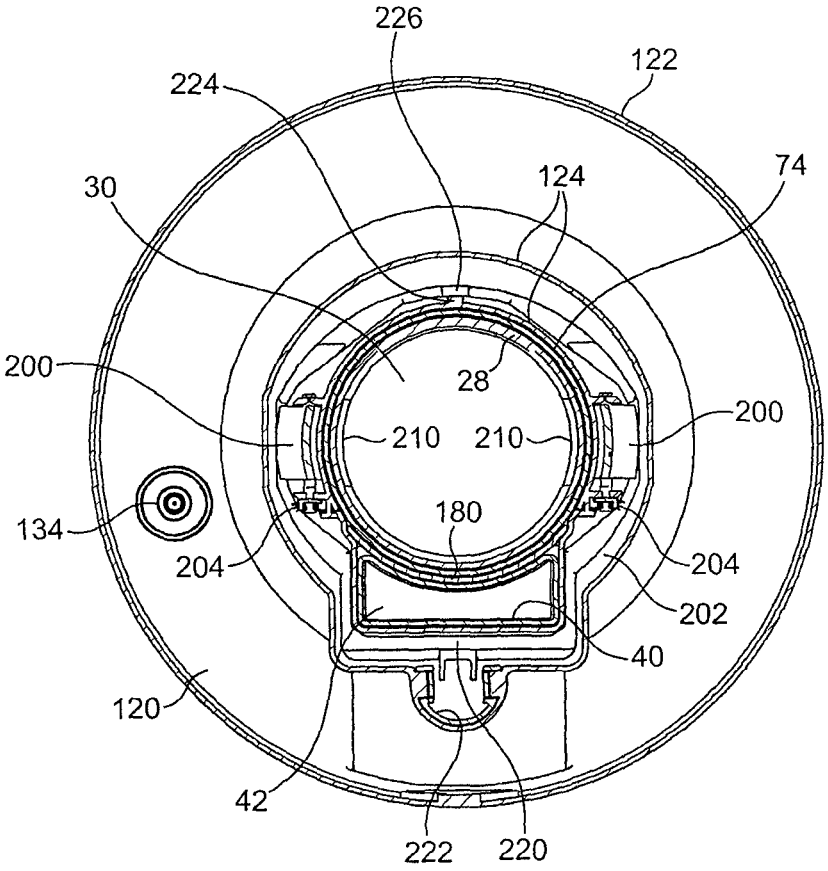
FIG. 11 is a top sectional view taken along line E-E in FIG. 4(*a*)

When the nozzle 14 is mounted on the body 12, the base 28 of the first outer casing section 22 of the nozzle 14 is located over the open end of the upper cylindrical section 74 of the upper wall of the base 56, and the base 40 of the second outer casing section 32 of the nozzle 14 is located over the open upper end of the outlet duct 106 of the water tank 120. The user then pushes the nozzle 14 towards the body 12. As illustrated in FIG. 10, a pin 190 is formed on the lower surface of the first outer casing section 22 of the nozzle 14, immediately behind the base 28 of the first outer casing section 22. As the nozzle 14 moves towards the body 12, the pin 190 pushes the handle 184 towards its stowed position, against the biasing force of the resilient elements 188. When the bases 28, 40 of the nozzle 14 are fully inserted in the body 12, annular sealing members 192 form air-tight seals between the ends of the bases 28, 40 and annular ledges 194 formed in the upper cylindrical section 74 of the upper wall of the base 56, and in the outlet duct 106. The upper wall 126 of the water tank 120 has a concave shape so that, when the nozzle 14 is mounted on the body 12, the water tank 120 surrounds a lower part of the nozzle 14. This not only can this allow the capacity of the water tank 120 to be increased, but can also provide the humidifying apparatus 10 with a compact appearance.

The body 12 comprises a mechanism for releasably retaining the nozzle 14 on the body 12. FIGS. 4(*a*), 11 and 12(*a*) illustrate a first configuration of the mechanism when the nozzle 14 is retained on the body 12, whereas FIGS. 4(*b*) and 12(*b*) illustrate a second configuration of the mechanism when the nozzle 14 is released from the body 12. The mechanism for releasably retaining the nozzle 14 on the body 12 comprises a pair of detents 200 which are located on diametrically opposed sides of an annular housing 202. Each detent 200 has a generally L-shaped cross-section. Each detent 200 is pivotably moveable between a deployed position for retaining the nozzle 14 on the body 12, and a stowed position. Resilient elements 204, such as torsion springs, are located within the housing 202 for biasing the detents 200 towards their deployed positions.

In this example, the water tank 120 comprises the mechanism for releasably retaining the nozzle 14 on the body 12. The housing 202 comprises a pair of diametrically opposed apertures 206 which align with similarly shaped apertures 208 formed on the upper cylindrical section 74 of the upper wall of the base 56 when the water tank 120 is mounted on the base 56. The outer surface of the base 28 of the nozzle 14 comprises a pair of diametrically opposed recesses 210 which align with the apertures 206, 208 when the nozzle 14 is mounted on the body 12. When the detents 200 are in their deployed position, the ends of the detents 200 are urged through the apertures 206, 208 by the resilient elements 204 to enter the recesses 210 in the nozzle 14. The ends of the detents 200 engage the recessed outer surface of the base 28 of the nozzle 14 to prevent the nozzle 14 from becoming withdrawn from the body 12, for example if the humidifying apparatus 10 is lifted by a user gripping the nozzle 14.

The body 12 comprises a depressible catch 220 which is operable to move the mechanism from the first configuration to the second configuration, by moving the detents 200 away from the recesses 210 to release the nozzle 14 from the body 12. The catch 220 is mounted within the housing 202 for pivoting movement about an axis which is orthogonal to the axes about which the detents 200 pivot between their stowed and deployed positions. The catch 220 is moveable from a stowed position, as illustrated in FIGS. 4(*a*), 11 and 12(*a*), to a deployed position, as illustrated in FIGS. 4(*b*), 7(*a*), 7(*b*) and 12(*b*), in response to a user depressing a button 222 located on the body 12. In this example, the button 222 is located on the upper wall 126 of the water tank 120 and above a front section of the catch 220. A compression spring or other resilient element may be provided beneath the front section of the catch 220 for urging the catch 220 towards is stowed position. The rotational axis of the catch 220 is located proximate to the front section of the catch so that, as the catch 220 moves towards its deployed position, the catch 220 urges the detents 200 to pivot away from the recesses 210 against the biasing force of the resilient elements 204.

The body 12 is configured to retain the catch 220 in its deployed position when the user releases the button 220. In this example, the housing 202 of the water tank 120 comprises a wedge 224 over which a hook 226 located on the rear section of the catch 220 slides as the catch 220 moves towards its deployed position. In the deployed position, the end of the hook 226 snaps over the tapered side surface of the wedge 224 to engage the upper surface of the wedge 224, resulting in the catch 220 being retained in its deployed position. As the hook 226 moves over the upper surface of the wedge 224, the hook 226 engages the bottom of the handle 184 and urges the handle 184 upwardly away from the recessed section 186 of the water tank 120. This in turn causes the handle 184 to push the nozzle 14 slightly away from the body 12, providing a visual indication to the user that the nozzle 14 has been released from the body 12. As an alternative to having features on the water tank 120 and the catch 220 which cooperate to retain the catch 220 in its deployed position, one or more magnets may be used to retain the catch 220 in its deployed position.

In its deployed position, the catch 220 holds the detents 200 in their stowed positions, as illustrated in FIGS. 4(*b*) and 12(*b*), to allow the user to remove the nozzle 14 from the body 12. As the nozzle 14 is lifted from the body 12, the resilient elements 188 urge the handle 184 to its deployed position.

The user can then use the handle 184 to lift the water tank 120 from the base 56 to allow the water tank 120 to be filled or cleaned as required.

Once the water tank 120 has been filled or cleaned, the user replaces the water tank 120 on the base 56, and then replaces the nozzle 14 on the body 12. As the bases 28, 40 of the nozzle 14 are pushed into the body 12 the pin 190 on the nozzle 14 engages the handle 184 and pushes the handle 184 back to its stowed position within the recessed section 186 of the water tank 120. As the handle 184 moves to its stowed position, it engages the hook 226 on the catch 220 and pushes the hook 226 away from the upper surface of the wedge 224 to release the catch 220 from its deployed position. As the hook 226 moves away from the wedge 224, the resilient elements 204 urge the detents 200 towards their deployed positions to retain the nozzle 14 on the body 12. As the detents 200 move towards their deployed position, the detents 200 move the catch 220 back to its stowed position.

Figure 13:
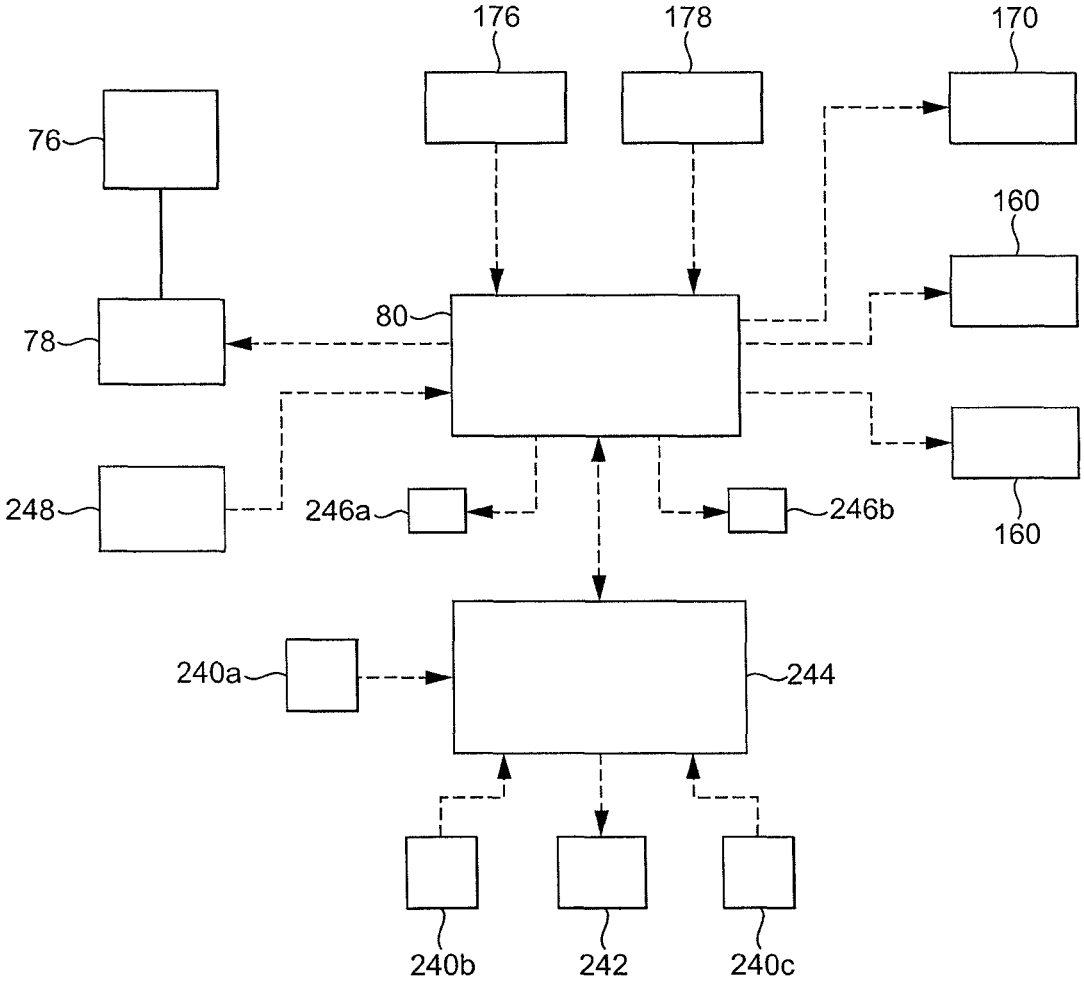
FIG. 13 is a schematic illustration of a control system of the humidifying apparatus.

A user interface for controlling the operation of the humidifying apparatus is located on the outer wall 58 of the base 56 of the body 12. FIG. 13 illustrates schematically a control system for the humidifying apparatus 10, which includes this user interface and other electrical components of the humidifying apparatus 10. In this example, the user interface comprises a plurality of user-operable buttons 240*a*, 240*b* and 240*c*, and a display 242. The first button 240*a* is used to activate and deactivate the motor 78, and the second button 240*b* is used to set the speed of the motor 78, and thus the rotational speed of the impeller 76. The third button 240*c* is used to set a desired level for the relative humidity of the environment in which the humidifying apparatus 10 is located, such as a room, office or other domestic environment. For example, the desired relative humidity level may be selected within a range from 30 to 80% at 20° C. through repeated actuation of the third button 240*c*. The display 242 provides an indication of the currently selected relative humidity level.

The user interface further comprises a user interface circuit 244 which outputs control signals to the drive circuit 80 upon actuation of one of the buttons, and which receives control signals output by the drive circuit 80. The user interface may also comprise one or more LEDs for providing a visual alert depending on a status of the humidifying apparatus. For example, a first LED 246*a* may be illuminated by the drive circuit 80 indicating that the water tank 120 has become depleted, as indicated by a signal received by the drive circuit 80 from the level sensor 176.

A humidity sensor 248 is also provided for detecting the relative humidity of air in the external environment, and for supplying a signal indicative of the detected relative humidity to the drive circuit 80. In this example the humidity sensor 248 may be located immediately behind the air inlet 60 to detect the relative humidity of the air flow drawn into the humidifying apparatus 10. The user interface may comprise a second LED 246*b* which is illuminated by the drive circuit 80 when an output from the humidity sensor 248 indicates that the relative humidity of the air flow entering the humidifying apparatus 10, $H_D$, is at or above the desired relative humidity level, $H_S$, set by the user.

Figure 14:
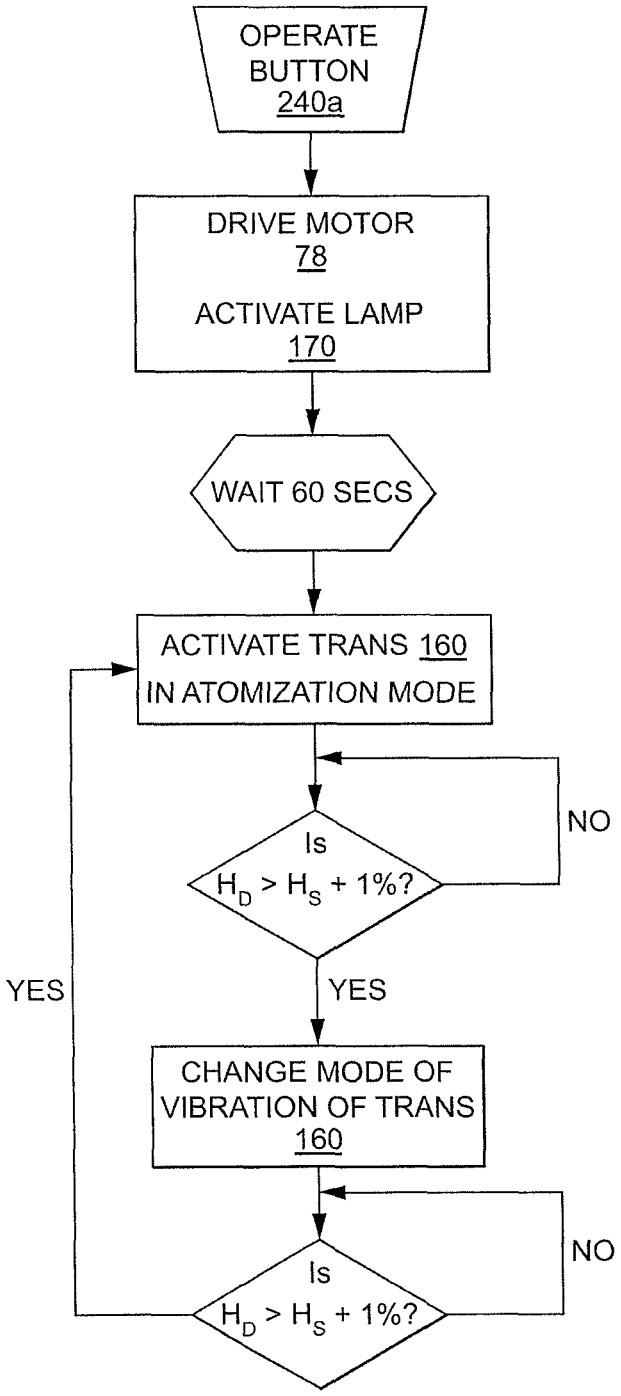
FIG. 14 is a flow diagram illustrating steps in the operation of the humidifying apparatus.

With reference also to FIG. 14, to operate the humidifying apparatus 10, the user actuates the first button 240*a*. The operation of the button 240*a* is communicated to the drive circuit 80, in response to which the drive circuit 80 actuates the UV lamp 170 to irradiate water stored in the water reservoir 140. In this example, the drive circuit 80 simultaneously activates the motor 78 to rotate the impeller 76. The rotation of the impeller 76 causes air to be drawn into the body 12 through the air inlet 60. An air flow passes through the impeller housing 88 and the diffuser 86. Downstream from the diffuser 86, a portion of the air emitted from the diffuser 86 enters the inlet duct 100 through the inlet port 102, whereas the remainder of the air emitted from the diffuser 86 is conveyed along the first air passageway 62 to the first air inlet 30 of the nozzle 14. The impeller 76 and the motor 78 may thus be considered to generate a first air flow which is conveyed to the nozzle 14 by the first air passageway 62 and which enters the nozzle 14 through the first air inlet 30.

The first air flow enters the first interior passage 48 at the base of the rear section 16 of the nozzle 14. At the base of the first interior passage 48, the air flow is divided into two air streams which pass in opposite directions around the bore 20 of the nozzle 14. As the air streams pass through the first interior passage 48, air enters the mouth 50 of the nozzle 14. The air flow into the mouth 50 is preferably substantially even about the bore 20 of the nozzle 14. The mouth 50 guides the air flow towards the first air outlet 44 of the nozzle 14, from where it is emitted from the humidifying apparatus 10.

The air flow emitted from the first air outlet 40 causes a secondary air flow to be generated by the entrainment of air from the external environment, specifically from the region around the first air outlet 44 and from around the rear of the nozzle 14. Some of this secondary air flow passes through the bore 20 of the nozzle 14, whereas the remainder of the secondary air flow becomes entrained within the air flow emitted from the first air outlet in front of the nozzle 14.

As mentioned above, with rotation of the impeller 76 air enters the second air passageway 64 through the inlet port 102 of the inlet duct 100 to form a second air flow. The second air flow passes through the inlet duct 100 and is emitted through the outlet port 104 over the water stored in the water reservoir 140. The emission of the second air flow from the outlet port 104 agitates the water stored in the water reservoir 140 to generate movement of water along and around the UV lamp 170, increasing the volume of water which is irradiated by the UV lamp 170. The presence of the threshold inhibitor within the stored water causes a thin layer of the threshold inhibitor to be formed on the surfaces of the tube 172 and the transducers 160 which are exposed to the stored water, inhibiting the precipitation of limescale on those surfaces. This can both prolong the working life of the transducers 160 and inhibit any degradation in the illumination of the stored water by the UV lamp 170.

In addition to the agitation of the water stored in the water reservoir 140 by the second air flow, the agitation may also be performed by the vibration of the transducers 160 in an agitation mode which is insufficient to cause atomization of the stored water. Depending, for example on the size and the number of transducers 160 of the base 56, the agitation of the stored water may be performed solely by vibration of the transducers 160 at a reduced second frequency $f_2$, and/or at a reduced amplitude, or with a different duty cycle. In this case, the drive circuit 80 may be configured to actuate the vibration of the transducers 160 in this agitation mode simultaneously with the irradiation of the stored water by the UV lamp 170.

The agitation and irradiation of the stored water continues for a period of time sufficient to reduce the level of bacteria within the water reservoir 140 by a desired amount. In this example, the water reservoir 140 has a maximum capacity of 200 ml, and the agitation and irradiation of the stored water continues for a period of 60 seconds before atomization of the stored water commences. The duration of this period of time may be lengthened or shortened depending on, for example, the degree of agitation of the stored water, the capacity of the water reservoir 140, and the intensity of the irradiation of the stored water, and so depending on these variables the duration of this period of time may take any value in the range of 10 to 300 seconds to achieve the desired reduction in the number of bacteria within the stored water.

At the end of this period of time, the drive circuit 80 actuates the vibration of the transducers 160 in the atomization mode to atomize water stored in the water reservoir 140. This creates airborne water droplets above the water located within the water reservoir 140. In the event that the stored water was agitated previously by vibration of the transducers 160 alone, the motor 78 is also activated at this end of this period of time.

As water within the water reservoir 140 is atomized, the water reservoir 140 is constantly replenished with water received from the water tank 120 via the water treatment chamber 142, so that the level of water within the water reservoir 140 remains substantially constant while the level of water within the water tank 120 gradually falls.

As water enters the water reservoir 140 from the water treatment chamber 142, in which the threshold inhibitor is added to the water, it is guided by the walls 174 to flow along the tube 172 so that it is irradiated with ultraviolet radiation before it is atomized.

With rotation of the impeller 76, airborne water droplets become entrained within the second air flow emitted from the outlet port 104 of the inlet duct 100. The—now moist—second air flow passes upwardly through the outlet duct 106 of the second air passageway 64 to the second air inlet 42 of the nozzle 14, and enters the second interior passage 54 within the front section 18 of the nozzle 14.

At the base of the second interior passage 54, the second air flow is divided into two air streams which pass in opposite directions around the bore 20 of the nozzle 14. As the air streams pass through the second interior passage 54, each air stream is emitted from a respective one of the second air outlets 52 located in the front end of the nozzle 14 in front of the first air outlet 44. The emitted second air flow is conveyed away from the humidifying apparatus 10 within the air flow generated through the emission of the first air flow from the nozzle 14, thereby enabling a humid air current to be experienced rapidly at a distance of several meters from the humidifying apparatus 10.

The moist air flow is emitted from the nozzle 14 until the relative humidity $H_D$ of the air flow entering the humidifying apparatus 10, as detected by the humidity sensor 248, is 1% at 20° C. higher than the relative humidity level $H_S$, selected by the user using the third button 240*c*. The emission of the moistened air flow from the nozzle 14 may then be terminated by the drive circuit 80, preferably by changing the mode of vibration of the transducers 160. For example, the frequency of the vibration of the transducers 160 may be reduced to a frequency $f_3$, where $f_1>f_3\geq 0$, below which atomization of the stored water is not performed. Alternatively the amplitude of the vibrations of the transducers 160 may be reduced. Optionally, the motor 78 may also be stopped so that no air flow is emitted from the nozzle 14. However, when the humidity sensor 248 is located in close proximity to the motor 78 it is preferred that the motor 78 is operated continually to avoid undesirable temperature fluctuation in the local environment of the humidity sensor 248. Also, it is preferred to continue to operate the motor 78 to continue agitating the water stored in the water reservoir 140. Operation of the UV lamp 170 is also continued.

As a result of the termination of the emission of a moist air flow from the humidifying apparatus 10, the relative humidity $H_D$ detected by the humidity sensor 248 will begin to fall. Once the relative humidity of the air of the environment local to the humidity sensor 248 has fallen to 1% at 20° C. below the relative humidity level $H_S$ selected by the user, the drive circuit 80 re-activates the vibration of the transducers 160 in the atomization mode. If the motor 78 has been stopped, the drive circuit 80 simultaneously re-activates the motor 78. As before, the moist air flow is emitted from the nozzle 14 until the relative humidity $H_D$ detected by the humidity sensor 248 is 1% at 20° C. higher than the relative humidity level $H_S$ selected by the user.

This actuation sequence of the transducers 160 (and optionally the motor 78) for maintaining the detected humidity level around the level selected by the user continues until button 240*a* is actuated again, or until a signal is received from the level sensor 176 indicating that the level of water within the water reservoir 140 has fallen below the minimum level. If the button 240*a* is actuated, or upon receipt of this signal from the level sensor 176, the drive circuit 80 deactivates the motor 78, the transducers 160 and the UV lamp 170 to switch off the humidifying apparatus 10. The drive circuit 80 also deactivates these components of the humidifying apparatus 10 in response to signal received from the proximity sensor 182 indicating that the water tank 120 has been removed from the base 56.

The invention claimed is:

1. A humidifying apparatus comprising:

a base comprising an air flow generating device for generating a first air flow and a second air flow;

a nozzle comprising at least one first air outlet for emitting the first air flow, the nozzle defining an opening through which air from outside the humidifying apparatus is drawn by air emitted from said at least one first air outlet;

a humidifying system for humidifying the second air flow;

at least one second air outlet for emitting the second air flow; and a water tank removably mounted on the base, and wherein the water tank surrounds at least an upper section of the air flow generating device.

2. The apparatus of claim 1, wherein the base comprises a duct for conveying the first air flow from the air flow generating device to the nozzle, and wherein the water tank surrounds the duct.

3. The apparatus of claim 1, wherein the base comprises an inlet duct for conveying the second air flow to the humidifying system.

4. The apparatus of claim 3, wherein the water tank surrounds at least an upper section of the inlet duct.

5. The apparatus of claim 3, wherein the inlet duct comprises an air inlet port located downstream from the air flow generating device.

6. The apparatus of claim 1, wherein the water tank comprises an outlet duct for conveying the second air flow to the at least one second air outlet.

7. The apparatus of claim 1, wherein the humidifying system comprises a water reservoir for receiving water from the water tank and an atomizing device for atomizing water in the reservoir to humidify the second air flow, and wherein the base comprises the water reservoir and the atomizing device.

8. The apparatus of claim 7, wherein the nozzle comprises said at least one second air outlet for emitting the second air flow.

9. The apparatus of claim 8, wherein the nozzle comprises at least one first air inlet for receiving the first air flow, a first interior passage for conveying the first air flow to said at least one first air outlet, at least one second air inlet for receiving the second air flow, and a second interior passage for conveying the second air flow air to said at least one second air outlet.

10. The apparatus of claim 9, wherein the first interior passage is isolated from the second interior passage.

11. The apparatus of claim 9, wherein the first interior passage surrounds the opening of the nozzle.

12. The apparatus of claim 9, wherein the second interior passage surrounds the opening of the nozzle.

13. The apparatus of claim 1, wherein said at least one first air outlet is arranged to emit the first air flow through at least a front part of the opening of the nozzle.

* * * * *